US012490842B1

(12) United States Patent
East et al.

(10) Patent No.: US 12,490,842 B1
(45) Date of Patent: Dec. 9, 2025

(54) SECURITY TOOL HOLDER FOR BATTERY POWERED TOOLS

(71) Applicant: American Display & Fixture, LLC, Dalton, GA (US)

(72) Inventors: Dion East, Hixson, TN (US); Mark Bullock, Chattanooga, TN (US); Steve Harlan, Hixson, TN (US); Michael Bolin, Ringgold, GA (US)

( * ) Notice: Subject to any disclaimer, the term of this patent is extended or adjusted under 35 U.S.C. 154(b) by 0 days.

(21) Appl. No.: 18/889,269

(22) Filed: Sep. 18, 2024

(51) Int. Cl.
*A47F 1/12* (2006.01)
*A47F 7/00* (2006.01)

(52) U.S. Cl.
CPC ..... *A47F 1/128* (2013.01); *A47F 7/0021* (2013.01)

(58) Field of Classification Search
CPC ..... A47F 1/128; A47F 7/0021; A45F 5/1575; B25G 1/085; B25B 23/16; B25H 3/003; B65D 85/20; B25F 5/029
See application file for complete search history.

(56) References Cited

U.S. PATENT DOCUMENTS 7,942,299 B2 * 5/2011 Steinbrunner ..... B25C 7/00 224/904
8,998,057 B2 * 4/2015 Gathers ..... A45F 5/021 224/269
9,038,873 B2 * 5/2015 Moreau ..... A45F 5/021 224/269
9,551,367 B1 * 1/2017 Shieh ..... A45F 5/021
11,744,352 B1 * 9/2023 Chambers ..... A45F 5/021 224/667
11,819,112 B1 * 11/2023 Daniels ..... A45F 5/021
11,986,941 B2 * 5/2024 Kadlecek ..... B25F 5/02
2002/0179659 A1 * 12/2002 Shaw ..... A45F 5/021 224/904
2003/0085243 A1 * 5/2003 Kahn ..... B25H 3/006 224/904
2007/0102176 A1 * 5/2007 Liao ..... B25F 5/00 173/171
2011/0139479 A1 * 6/2011 Nagasaka ..... B25F 5/02 173/217
2018/0199698 A1 * 7/2018 Fiorello ..... A44B 99/005
2018/0279752 A1 * 10/2018 Woodhams ..... A45F 5/021
2021/0078158 A1 * 3/2021 Wages ..... F16M 13/02
2022/0000252 A1 * 1/2022 St Jacques ..... A45F 5/021

* cited by examiner

*Primary Examiner* — Ko H Chan
(74) *Attorney, Agent, or Firm* — Miller & Martin PLLC

(57) ABSTRACT

The disclosed embodiments include systems and methods configured to provide novel security tool holders that are configured to engage with the battery receiver slots of a variety of different battery-powered tools to securely display and hold the tools in a retail merchandise display. In the disclosed embodiments, the security tool holders comprise a base that attaches to a merchandise display system, such as on a shelf, and a tool mount portion on the base that is configured to engage with a battery receiver slot to attach a battery powered tool to the base. In some embodiments, the security tool holder may be formed by cutting a two-dimensional shape out of a single sheet of material, then bending the two-dimensional shape at predetermined locations to form the three-dimensional security tool holder.

20 Claims, 34 Drawing Sheets

SECURITY TOOL HOLDER FOR BATTERY POWERED TOOLS

FIELD OF THE INVENTION

The present disclosure relates generally to apparatuses and techniques for securing a power tool in a retail merchandise display and, more particularly, to inventive security tool holders that may be configured to cooperate with battery receiver slots of various battery powered tools in order to display the tools while preventing them from being easily removed from the merchandise display.

BACKGROUND OF THE INVENTION

Secure product displays are frequently used in retail environments to display handheld power tools for sale. The handheld power tool may be any tool that is portable, runs on electrical power (such as a battery), and is operated by hand. As used herein, a battery powered tool is a handheld power tool that runs on battery power. The secure product displays are typically configured in a way that allows customers to physically inspect and test the grip of a sample handheld power tool, while also securing the tool to the display to prevent retail theft. While it is advantageous for retailers to provide such physical samples to customers to increase their sales of these power tools, the sample tools are often the target of retail theft due to their relatively compact size, high value, and ease of removal from the retailer's merchandise display.

Retailers currently employ several mechanisms for securing handheld power tools to their merchandise displays. For instance, wire tethers, cables, or other lanyards (collectively, "wire tethers") are commonly used to secure sample power tools in a merchandise display. One end of the wire tether is typically secured to a handle of the power tool and the other end of the tether is secured to the display itself, such as to a shelf or a post or bracket connected to the merchandise display system. The wire tethers may be either straight or coiled, but they are thin and flexible to allow customers to pick up and hold the sample power tools on display.

The wire tether security mechanism has significant disadvantages. First, because the power tool connected to the tether is not mounted in one place, the retail display (such as a shelf on a display rack) can quickly become cluttered and disorganized from customer interactions with multiple tethered power tools. Customers may place the power tools on top of each other, tangle their wire tethers, and otherwise render the display unsightly. The appearance and organization of product placement on the display can directly impact a customer's likelihood of purchasing one of the displayed power tools or even returning to the store. Another disadvantage of using wire tethers as a security mechanism is its ease of removal. Because wire tethers use a thin, flexible wire, thieves can quickly cut the wire with small, easily concealable wire cutters and steal the displayed power tool.

Another mechanism that retailers often use to secure handheld power tools on display uses an electronic beeping device. The device is typically tethered to a power tool's handle with a flexible, coiled wire, similar to the previously-described wire-tether mechanism, but instead of secured directly to the merchandise display, the tether is instead secured to a "beeper." This beeper will produce a loud audible chirp or other alarm sound if the wire is cut or pulled, and the audible alarm is used to alert store employees of a potential attempted theft. The audible chirp or alarm sound can only be disabled by an employee with an electronic key.

Like the wire tethers, there are several disadvantages to using an electronic beeping device as a security mechanism for displayed power tools. First, the electronic beeping devices are expensive and each tool on display needs its own beeping device. When a store is displaying a wide variety of tools from multiple manufacturers, using electronic beeping devices as the security mechanism can become cost prohibitive. Second, the wires connected to the electronic beeping devices still can be cut with easily concealable wire cutters. While the device will begin chirping loudly to alert employees, even if the theft is prevented, the expensive beeping device will need to be replaced or repaired before it can be used again. In addition, the electronic beeping devices are often overly sensitive and can be easily set off by a normal customer simply inspecting the handheld power tool on display. This creates an additional burden on the store employees who constantly must disable "false alarm" chirps from the electronic beeping devices.

Yet another common way that retailers secure their displayed handheld power tools is using plastic zip ties. Zip ties are a more cost-effective option than the other security display mechanisms. A handheld power tool is often secured to a shelf by a zip tie either wrapped around the handle and/or base of the tool and also through an opening on a display shelf. While this option is low cost, it also comes with disadvantages. First, depending on where the zip tie is wrapped around the tool, it may prevent the customer from being able to properly grip and inspect the power tool to ensure the customer's grip is comfortable and fits their needs. For example, a zip tie secured around the handle of a displayed power tool may inhibit the customer's hand from fully wrapping around the handle. Further, the zip ties are plastic and can be cut far more easily than either of the previously mentioned wire-tether-based security mechanisms and without the audible chirp of the electronic beeping device.

There is a need for improved security mechanisms for securing power tools in merchandising displays in retail environments. Unlike existing security mechanisms utilizing wire tethers, electronic beeping devices, or zip ties, an improved security mechanism should allow customers to easily inspect and interact with the handheld powered tools on display while also providing better security in preventing theft of the tools from the retail display.

SUMMARY OF THE INVENTION

The present invention overcomes the disadvantages of the prior art by providing novel security tool holders that are configured to engage with the battery receiver slots of a variety of different battery-powered tools to securely display and hold the tools in a retail display. The battery powered tools may include various types of handheld power tools including drills, ratchets, grinders, saws, routers, sanders, and the like, that receive electrical power from a battery. In the disclosed embodiments of the invention, each exemplary security tool holder comprises a tool mount portion that is configured to be at least partially inserted into a battery receiver slot of a battery powered tool, such as, for example, a 20 Volt (V) battery compartment of a handheld power tool. The disclosed embodiments describe several exemplary security tool holder designs in which the tool mount portion can be secured in the battery receiver slot.

In the disclosed embodiments, the security tool holders comprise a base that attaches to a merchandise display system, such as on a shelf, and a tool mount portion on the base that is configured to engage with a battery receiver slot to attach a battery powered tool to the base. In some embodiments, the tool mount portion may be formed as an integral part of the base, although it alternately could be a separate piece attached to the base. In some embodiments, the base may be formed by cutting a two-dimensional shape out of a single sheet of material, then bending the two-dimensional shape at predetermined locations to form the three-dimensional base. The single sheet of material may comprise aluminum, steel, or any other metal or other material having sufficient malleability and strength to form the base as described herein.

The tool mount portion may have a substantially flat top surface and substantially straight lateral edges that are configured to fit within and slide into a channel defined within the interior of the battery receiver slot of the battery powered tool. For example, in some embodiments, the tool mount portion may remain in a fixed position while the battery powered tool is moved (such as by sliding) to engage its battery receiver slot with the stationary tool mount portion. The outer edges of the tool mount portion may be aligned with corresponding grooves (or other guide channels) within the battery receiver slot, then the battery powered tool may be moved to slide the outer lateral edges of the tool mount portion into and along the length of the grooves. In some disclosed embodiments, the battery receiver slot may be configured to prevent the tool mount portion from being inserted past a certain position in the battery receiver slot. For example, the battery receiver slot may comprise an overhang or other physical obstruction that prevents the tool mount portion from sliding completely through the entire length of a groove or other guide channel in the battery receiver slot.

In a first set of exemplary embodiments, after the battery powered tool is mounted on the tool mount portion of the base via its battery receiver slot, a security screw may be connected to the base to prevent the battery powered tool from being removed in an opposite direction from which it was attached. For example, as discussed above, the shape of battery receiver slot may physically block movement (such as by sliding) of the battery powered tool on the tool mount portion in a first direction, and the security screw may be positioned to block removal of the battery powered tool from the tool mount portion in an opposite direction. The security screw may comprise a Torx® screw or other screw requiring a specialized bit-pattern to install and remove. In some embodiments, the security screw may be further protected by a plastic sleeve or other spacer and/or a lock nut.

In a second set of exemplary embodiments, the battery receiver slot of a battery powered tool may be attached to the tool mount portion in the same way as in the first set of exemplary embodiments, but instead of using a security screw on the base, the battery powered tool may be secured to the base using a lock bracket. In these exemplary embodiments, the lock bracket may be attached to a surface of the base, for example, using a security screw that extends through aligned openings in the lock bracket and the base, then the lock bracket may be secured in this position using a lock nut applied to the security screw on an opposite side of the base.

The lock bracket may comprise at least one surface having a protruding edge ("tab") configured to fit within, and extend through, an open area on the tool mount portion. In some embodiments, the protruding edge may extend orthogonally (or substantially at a right angle) from a surface on the lock bracket. In some exemplary embodiments, the tool mount portion may be generally I-shaped such that its top surface is generally rectangular with open areas formed along an opposing pair of side edges. In such embodiments, when the lock bracket is attached to the base, the protruding edge of the lock bracket extends through one of the open areas on the sides of the tool mount portion. In alternative embodiments, the open areas may be formed as holes (including slots) positioned at predetermined locations within the interior of the top surface of the tool mount portion. That is, unlike an open area on a side edge of the tool mount portion, each open area in these alternative embodiments instead may be formed as a fully-enclosed opening within the interior of the tool mount portion's top surface. In such alternative embodiments, when the lock bracket is attached to the base, the protruding edge of the lock bracket extends through one of the openings formed in the top surface of the tool mount portion.

According to the second exemplary embodiments described herein, when a battery powered tool is attached to the tool mount portion of the base and the lock bracket has been attached to the base, a protruding edge on the lock bracket preferably fits within, or otherwise engages with, a groove inside the battery receiver slot of the battery powered tool. The groove in the battery receiver slot may extend along a width of the battery receiver slot, for example, across substantially the entire width of the battery receiver slot. Accordingly, when the protruding edge of the lock bracket is positioned within the groove in the battery receiver slot, and the lock bracket is secured to the base, the protruding edge seated in the groove of the battery receiver slot can prevent a user from moving (such as by sliding) the battery powered tool off of the tool mount portion, thereby securing the battery power tool to the base.

In some exemplary embodiments, the lock bracket may be generally shaped as a right-angle bracket that can be rotated relative to a surface of the base so that it may be attached to the base at different angles. For example, the lock bracket may comprise separate first and second tab portions protruding from opposite ends of the right-angle bracket. In such embodiments, the lock bracket may be secured to the base in a first orientation where the first tab is positioned through a first open area of the tool mount portion of the base; the lock bracket alternatively may be rotated and secured to the base in a second orientation where the second tab can be positioned through a second open area of the tool mount portion. By using a lock bracket (such as but not limited to a right-angle shaped lock bracket) configured to be attached to the base at different angles, battery powered tools can be mounted on the tool mount portion in multiple directions and secured by appropriately rotating and securing the lock bracket on the base.

Further to the disclosed exemplary embodiments, the base of the security tool holders may be configured to support a price channel in which a marketing (or pricing) tag may be displayed to a consumer. In some embodiments, the price channel may be formed from a single piece of material, such as aluminum, steel, or other metal or type of material. For example, the price channel may be formed by bending a pair of lateral edges of a substantially rectangular shape of metal, e.g., forming a channel through which a display tag can be slid, and also forming one or more alignment holes at predetermined locations on an interior surface of the unbent metal. In such embodiments, a substantially vertical surface on the base of the security tool holder also may comprise one or more alignment holes. As such, the price channel may be attached to the base by aligning corresponding alignment hole(s) in the price channel and base and securing the price channel to the base using screws and nuts through each aligned holes.

In the exemplary embodiments, the base also preferably includes one or more holes along a bottom surface that can be used to attach the security tool holder to a merchandise display system. For example, in some embodiments, a bottom surface of the base may comprise a first hole that can be aligned with a first hole in a shelf of the merchandise display system. The base may further comprise a second hole, which in some embodiments may be an elongated slot, that can be aligned with a second hole in the shelf of the merchandise display system. In such embodiments, the security tool holder may be secured to the shelf, for example, using wing nuts (or the like) to secure screws inserted through the aligned first and second sets of holes in the base and shelf. Preferably, the wing nuts are only accessible through a security cage in the merchandise display system, which is only accessible to employees of the retailer, so customers cannot remove the fasteners that connect the base of the security tool holder to the shelf.

Those skilled in the art will appreciate that many variations of the exemplary security tool holders disclosed herein are possible. For example, in some disclosed embodiments, the top surface of the tool mount portion of the base may be substantially horizontal and parallel relative to at least one of the bottom surface of the security tool holder, the ground, or a shelf surface (or other surface) of a retail merchandise display. In other embodiments, the top surface of the tool mount portion may be positioned at a predetermined fixed angle, e.g., relative to the base or ground. And in yet other exemplary embodiments, the angle of the top surface of the tool mount portion may be adjustable such that a user can set the angle of the top mount portion and secure it at a desired angle relative to the base or ground. Those skilled in the art will further understand that various dimensions and shapes may be used for the base and tool mount portions of the security tool holders consistent with the disclosed embodiments. And while the base and tool mount portion may be formed from a single sheet of metal in some embodiments, in alternative embodiments they may be formed from multiple interconnected pieces.

The security tool holders in the disclosed embodiments provide significant advantages over existing apparatuses and techniques for securing battery powered tools in a retail merchandise display. For example, because the security tool holders of the disclosed embodiments connect to the battery receiver slots of battery powered tools, and the battery receiver slots are often substantially the same shapes and dimensions across multiple types of handheld power tools, the inventive security tool holders can be used to hold and secure a wide variety of different types of battery powered tools. The security tool holders are also highly configurable. The security tool holders disclosed in the exemplary embodiments can support many possible display configurations, where battery powered tools can be presented to consumers in different orientations and/or angles, and they are connectable to various types of merchandise display systems.

Advantageously, multiple security tool holders disclosed herein can be displayed on a single shelf in an organized and uncluttered manner, thereby providing consumers with full access to inspect the sample power tools on display while also ensuring improved security against their theft compared to prior security mechanisms. Further still, the security tool holders may be manufactured relatively inexpensively, for example, by forming their base from a single sheet of metal, which keeps their costs significantly lower than prior solutions.

These and other aspects, advantages, and features of the invention will become apparent to those skilled in the art based on the various exemplary embodiments disclosed in the following detailed description and appended claims with reference to the accompanying drawings, all of which form a part of this specification.

BRIEF DESCRIPTION OF THE DRAWINGS

The particular features and advantages of the invention will become apparent from the following description taken in connection with the accompanying drawings in which like reference numbers indicate identical or functionally similar elements. The following figures depict details of disclosed embodiments. The invention is not limited to the precise arrangement shown in these figures, as the accompanying drawings are provided merely as examples.

DETAILED DESCRIPTION OF THE DISCLOSED EMBODIMENTS

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific systems and methods described herein. Such equivalents are considered to be within the scope of this invention and are covered by the claims.

Figure 1:
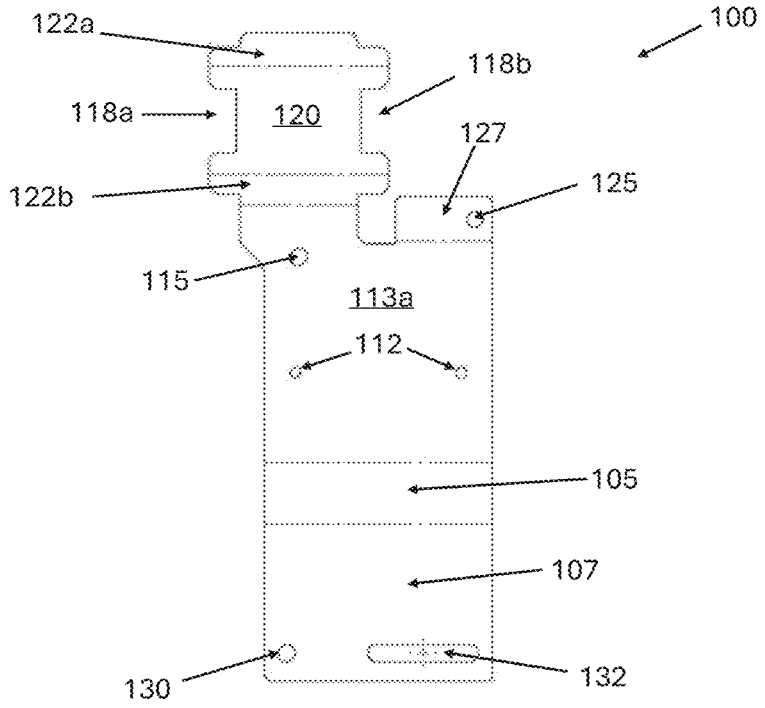
FIG. 1 is a top view of an exemplary shape that may be cut from a sheet of material to form a base of a security tool holder in accordance with a first set of disclosed embodiments of the invention.

FIGS. 1, 2A, 2B, 3, and 4 illustrate an exemplary embodiment of a security tool holder that may be used in accordance with a first set of disclosed embodiments. In this example, FIG. 1 shows a two-dimensional shape 100 that may be cut out from a sheet of metal, such as steel, aluminum, or another metal or alloy. The outline of shape 100 may be cut from the sheet of metal using a metal cutting machine, such as using a laser cutter or other cutting apparatus, or alternatively may be formed using additive or subtractive processes and other materials known in the art. The shape 100 includes holes 112, 115, 125, 130, and 132 therethrough, which may be formed using cutting, punching, etching, and/or any other means known in the art for creating such holes through the thickness of the material.

Figure 2A:
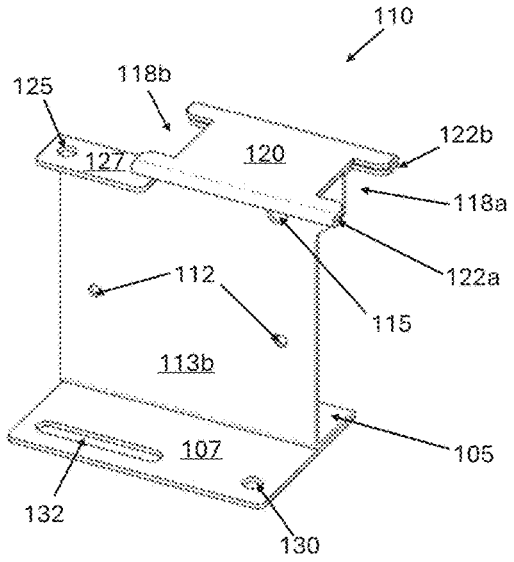
FIGS. 2A and 2B are back and front perspective views, respectively, of an exemplary base of a security tool holder that may be used in accordance with the first set of disclosed embodiments of the invention.
Figure 2B:
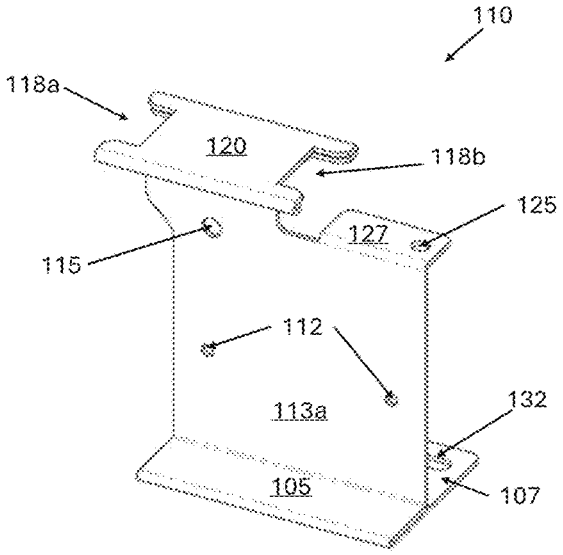
Figure 3:
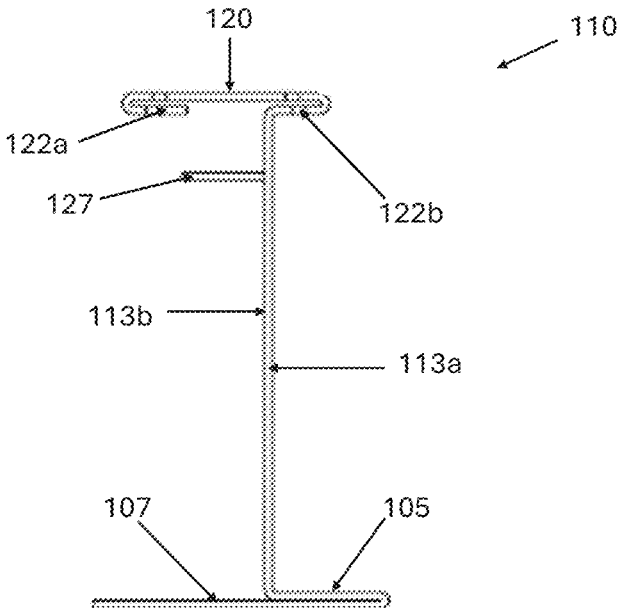
FIG. 3 is a side view of the exemplary security-tool-holder base of FIGS. 2A and 2B.
Figure 4:
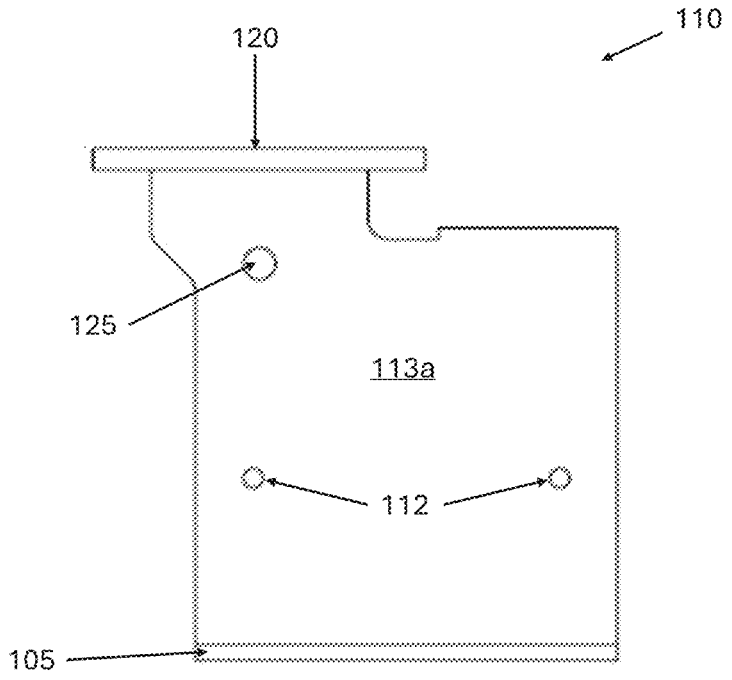
FIG. 4 is a front view of the exemplary security-tool-holder base of FIGS. 2A and 2B.

In FIG. 1, the two-dimensional shape 100 may be mechanically bent along each of the dashed horizontal lines to form the three-dimensional security tool holder 110 illustrated in FIGS. 2A-2B, 3, and 4. FIG. 2A shows a back perspective view of the security tool holder 110; FIG. 2B is a front perspective view of the same security tool holder 110; FIG. 3 is a right side view of the security tool holder 110; and FIG. 4 is a front view of the security tool holder 110.

Although the exemplary security tool holder 110 may be formed from a single piece of material, such as by bending the two-dimensional shape 100 as described above, in alternative embodiments the security tool holder may be formed by connecting multiple distinct pieces, such as by attaching separate pieces using welding, screws, bolts, or any other fastening means, to create the three-dimensional security tool holder 110 described herein. Accordingly, in the disclosed embodiments where the security tool holder 110 is formed from a single piece of material, it may be synonymously referenced as a "base" or "stand" for holding and displaying a battery powered tool. In alternative embodiments employing multiple interconnected pieces, the "base" or "stand" may refer to the one or more pieces that form at least the bottom surface 105/107 and vertical surfaces 113*a*/113*b* of the security tool holder 110.

The bottom surface of the security tool holder 110 comprises a back surface 107 and a front surface 105. In this example embodiment, the front surface 105 is higher than the back surface 107 as a result of having folded the front surface 105 over the back surface 107. A hole 130 in the back surface 107 may be sized and shaped to receive a screw therethrough. The hole 130 may be aligned with a first hole in a merchandise display system, such as on a shelf of the display system, and then secured to the display system using a screw and nut (or other fastener) inserted through the hole 130 and the aligned first hole in the display system. The back surface 107 includes another hole 132, which may be shaped as an elongated slot 132 (as shown), which can be aligned with a second hole in the merchandise display system. By using an elongated slot 132, there can be more tolerance for aligning the opening of the slot 132 with the second hole in the merchandise display system. A second screw and nut (or other fastener) may be inserted through the slot 132 and the aligned second hole of the display system to further secure the bottom surface 105/107 of the security tool holder 110 to the merchandise display system.

The security tool holder 110 further comprises a substantially vertical section having a front surface 113*a* and a back surface 113*b*. In some embodiments, the vertical section comprises one or more alignment holes 112, e.g., for connecting a price channel 310 to the front surface 113*a* of the security tool holder 110 as discussed below. One or more additional holes 115 may be positioned on the vertical section 113*a*/113*b*, e.g., for connecting to a lock bracket 210 that may be used in accordance with a second set of exemplary embodiments described below.

The security tool holder 110 comprises a tool mount portion 120. The tool mount portion 120 is shaped and sized to engage with at least a portion of a battery receiver slot of a battery powered tool. As such, the battery powered tool may be attached to the security tool holder 110 for display on a merchandise display system. In this example, the top surface of the tool mount portion 120 has a substantially flat top surface that may be substantially parallel to the bottom surface of the security tool holder. However, in alternative embodiments, the tool mount portion 120 may be positioned at a fixed angle relative to the bottom surface 105/107 of the security tool holder 110, e.g., to display the battery powered tool at a desired angle. For example, although not shown, the region 122*b* may be further bent to change the angle of the top surface of the tool mount portion 120 relative to the bottom surface 105/107. In yet other embodiments (not shown), the tool mount portion 120 may be pivotably connected, e.g., to the front surface 113*a* and/or back surface 113*b* and selectively rotated by a user and secured at a desired angle (such as by using a set screw or other mechanism for securing the angle).

In the first set of exemplary embodiments, the top surface of the tool mount portion 120 may be generally rectangular shaped with lateral edges 122*a* and 122*b*. The top surface may comprise open areas 118*a* and 118*b* respectively formed on its left and right sides for use with a lock bracket in accordance with a second set of exemplary embodiments described with reference to FIGS. 16-25. More generally, various sizes and shapes may be used for the tool mount portion 120, including its top and side surfaces, provided that it can operate as disclosed herein. For example, the size and shape of the tool mount portion 120 may be configured in various ways so long as it is operable to engage with a battery receiver slot of a battery powered tool consistent with the disclosed embodiments of the invention described herein.

The security tool holder 110 further comprises a security screw mount surface 127 including a hole 125 through which a security screw, such as a Torx® screw or other screw with a specialized bit pattern, may be attached. In the first set of exemplary embodiments, after the battery powered tool has been mounted on the tool mount portion 120 via its battery receiver slot, a security screw may be inserted through the hole 125 and secured in place, preferably using a lock nut. In such embodiments, the security screw extends sufficiently above the surface 127 to block movement of the battery powered tool mounted to the tool mount portion 120. Accordingly, as described further with reference to FIGS. 12-15, the battery powered tool may be moved in a first direction to attach it to the tool mount portion 120, and the security screw extending through the hole 125 and above the surface 127 prevents a user from moving the battery powered tool in an opposite direction to remove the battery powered tool from the tool mount portion 120.

Figure 5:
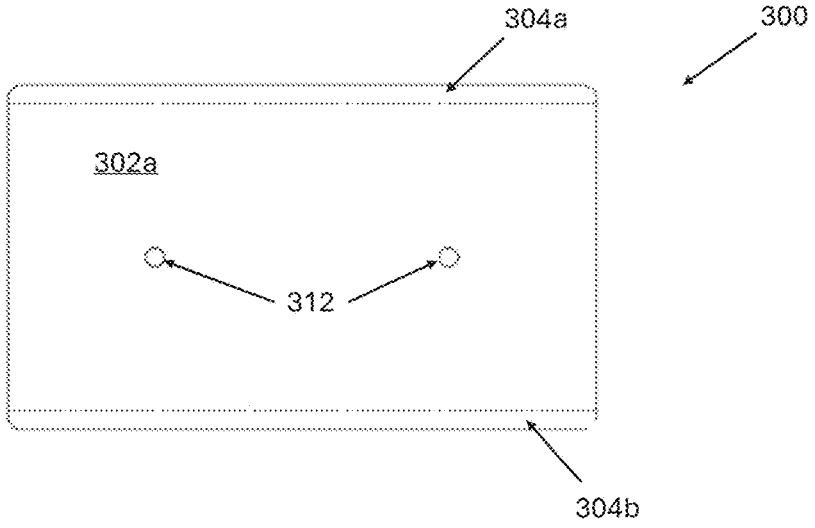
FIG. 5 is a top view of an exemplary shape that may be cut from a sheet of material to form a price tag channel for a security tool holder in accordance with certain disclosed embodiments of the invention.
Figure 6:
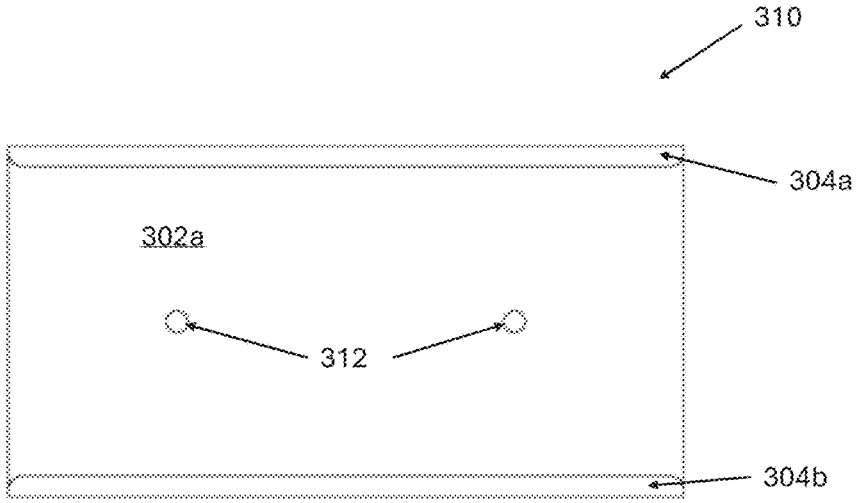
FIG. 6 is top view of an exemplary price tag channel that may be used in accordance with certain disclosed embodiments of the invention.
Figure 7:
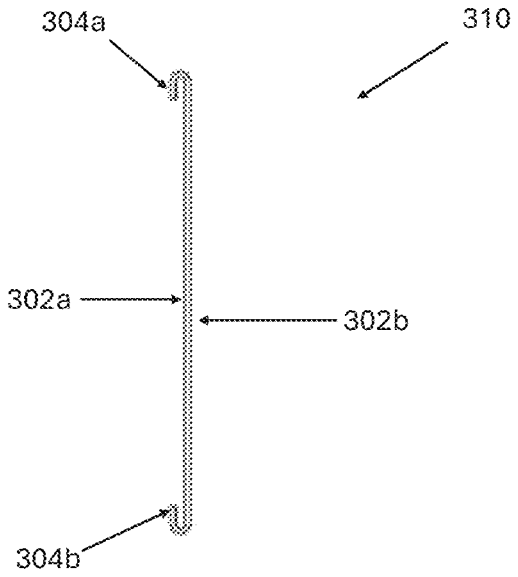
FIG. 7 is side view of the exemplary price tag channel of FIG. 6.

FIGS. 5-7 illustrate an exemplary embodiment of a price channel 310 (e.g., which also may be referred to as a "display channel," "tag channel," or "price tag channel") that may be used in accordance with the disclosed embodiments herein. The price channel 310 may be formed from a single piece of material. For example, FIG. 5 shows a generally rectangular two-dimensional shape 300 that may be cut out from a sheet of material, such as steel, aluminum, or another metal or alloy. The two-dimensional shape 300 may be cut from a sheet of metal using a metal cutting machine, such as using a laser cutter or other cutting apparatus, or alternatively may be formed using additive or subtractive processes and other materials known in the art. The shape 300 includes a front surface 302*a* and a back surface 302*b* with one or more alignment holes 312 therethrough. Each hole 312 may be formed using cutting, punching, etching, and/or any other means known in the art for creating such holes through the thickness of the material.

In FIG. 5, the two-dimensional shape 300 may be mechanically bent along each of the dashed horizontal lines, thereby bending each of the top section 304*a* and bottom section 304*b* in the same direction toward the front surface 302*a*, to form the three-dimensional price channel 310 shown in FIGS. 6 and 7. The bent portions 304*a* and 304*b* define the top and bottom of a channel in which a display tag can be slidably inserted. The display tag (not shown) may comprise a paper tag, plastic tag, laminated paper tag, etc., on which is printed pricing and/or other information about a battery powered tool on display to a consumer.

Figure 8A:
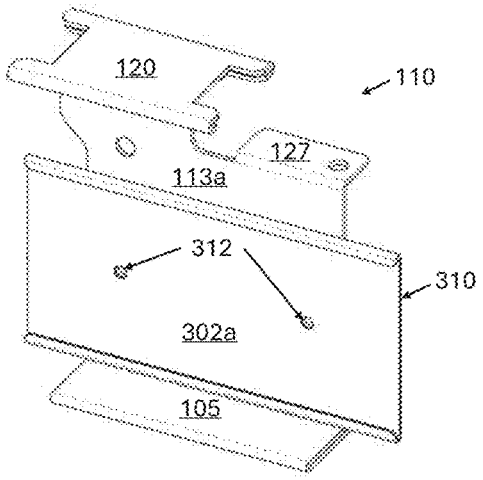
FIGS. 8A and 8B are front and back perspective views, respectively, of the exemplary price tag channel of FIG. 6 positioned on a front surface of the exemplary security-tool-holder base of FIGS. 2A and 2B in accordance with certain disclosed embodiments of the invention.
Figure 8B:
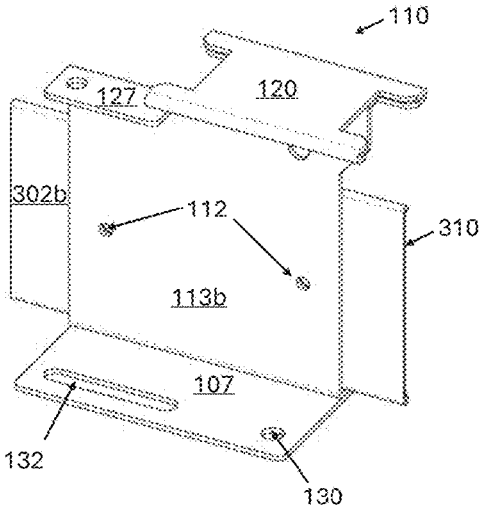

FIGS. 8A and 8B are front and back perspective views, respectively, of the exemplary price channel 310 of FIG. 6 positioned on a front surface 113*a* of the exemplary security tool holder 110 of FIGS. 2A and 2B. The one or more alignment holes 312 of the price channel 310 are aligned with corresponding holes 112 in the vertical section 113*a*/113*b* of the base of the security tool holder. A screw, such as a security screw, or other fastener may be inserted through each pair of aligned holes 312 and 112 and secured with a nut on the opposite side.

Figure 9:
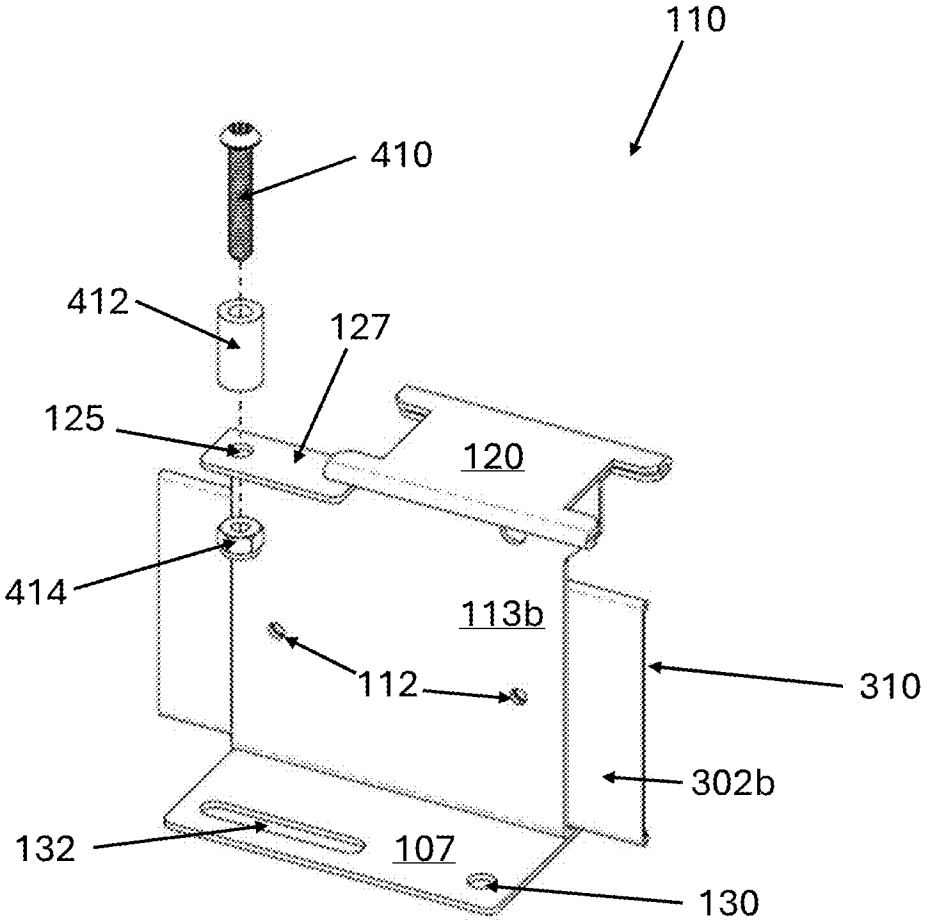
FIG. 9 is a back perspective view of an exemplary security screw, spacer, and lock nut that may be attached to the exemplary security-tool-holder base of FIGS. 2A and 2B, with the exemplary price tag channel of FIG. 6 positioned on a front surface of the base, in accordance with certain disclosed embodiments of the invention.

FIG. 9 is a back perspective view of the security tool holder 110 showing an exemplary security screw 410, spacer 412, and lock nut 414 that may be attached to the security tool holder through the hole 125 of the surface 127. The security screw 410 may be a Torx® screw or another screw having a specialized bit pattern on its head that makes it difficult or impossible for a customer to remove using most conventional screwdrivers. The security screw may be formed of a metal or plastic material. The spacer 412 may be generally shaped as a cylinder and, in some embodiments, formed of a plastic material, such as a plastic sleeve through which the security screw 410 may be inserted. The height of the spacer 412 is configured to ensure that the security screw 410, when inserted through the spacer 412, extends sufficiently above the surface 127 to block removal of a battery powered tool 700 mounted on the tool mount portion 120 while also extending sufficiently below the surface 127 to connect to the lock nut 414. The lock nut 414 may be a plastic nylon lock nut or another type of lock nut known in the art.

Figure 10:
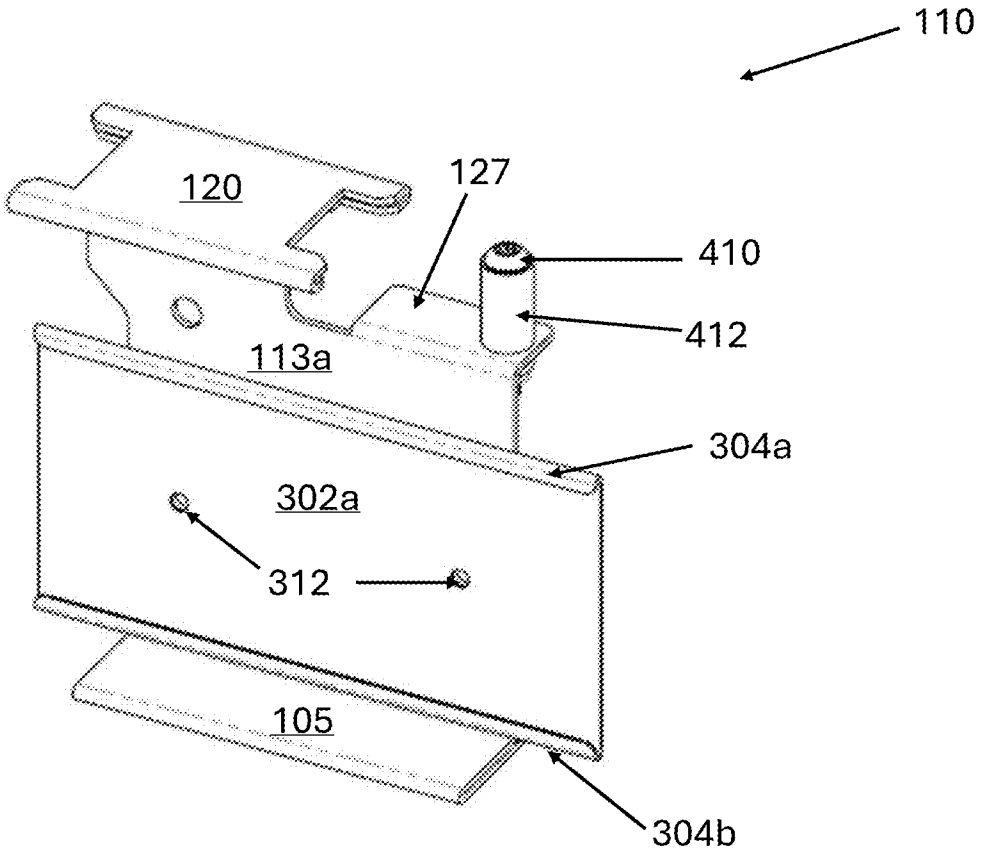
FIG. 10 is a front perspective view of an exemplary security screw, spacer, and lock nut after they are attached to the exemplary security-tool-holder base of FIGS. 2A and 2B, with the exemplary price tag channel of FIG. 6 positioned on a front surface of the base, in accordance with certain disclosed embodiments of the invention.
Figure 11:
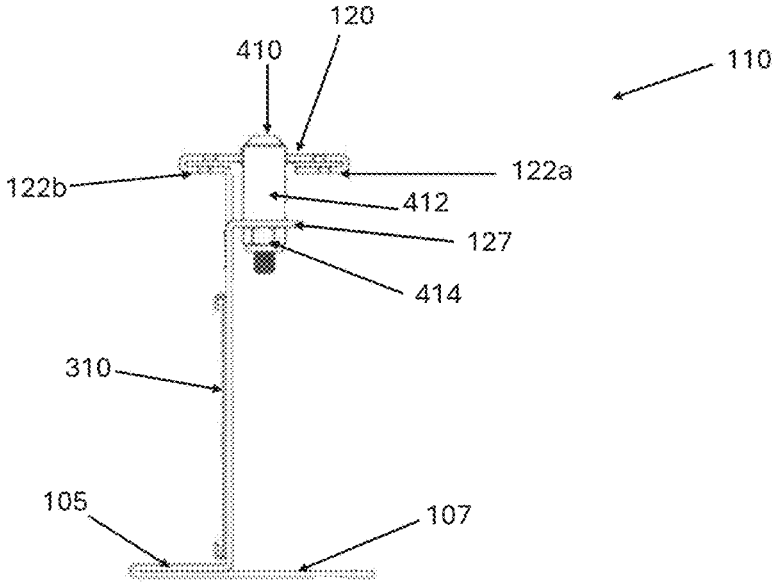
FIG. 11 is a side view of the exemplary security-tool-holder base of FIG. 10, including the exemplary security screw, spacer, and lock nut, and price tag channel of FIG. 6.

FIG. 10 is a front perspective view of the exemplary security screw 410, spacer 412, and lock nut 414 after they are attached to the exemplary security tool holder 110 with the price channel 310 also positioned on the front of the security tool holder. FIG. 11 is a side view of the exemplary security tool holder 110 including the exemplary security screw 410, spacer 412, and lock nut 414, and price channel 310.

Figure 12:
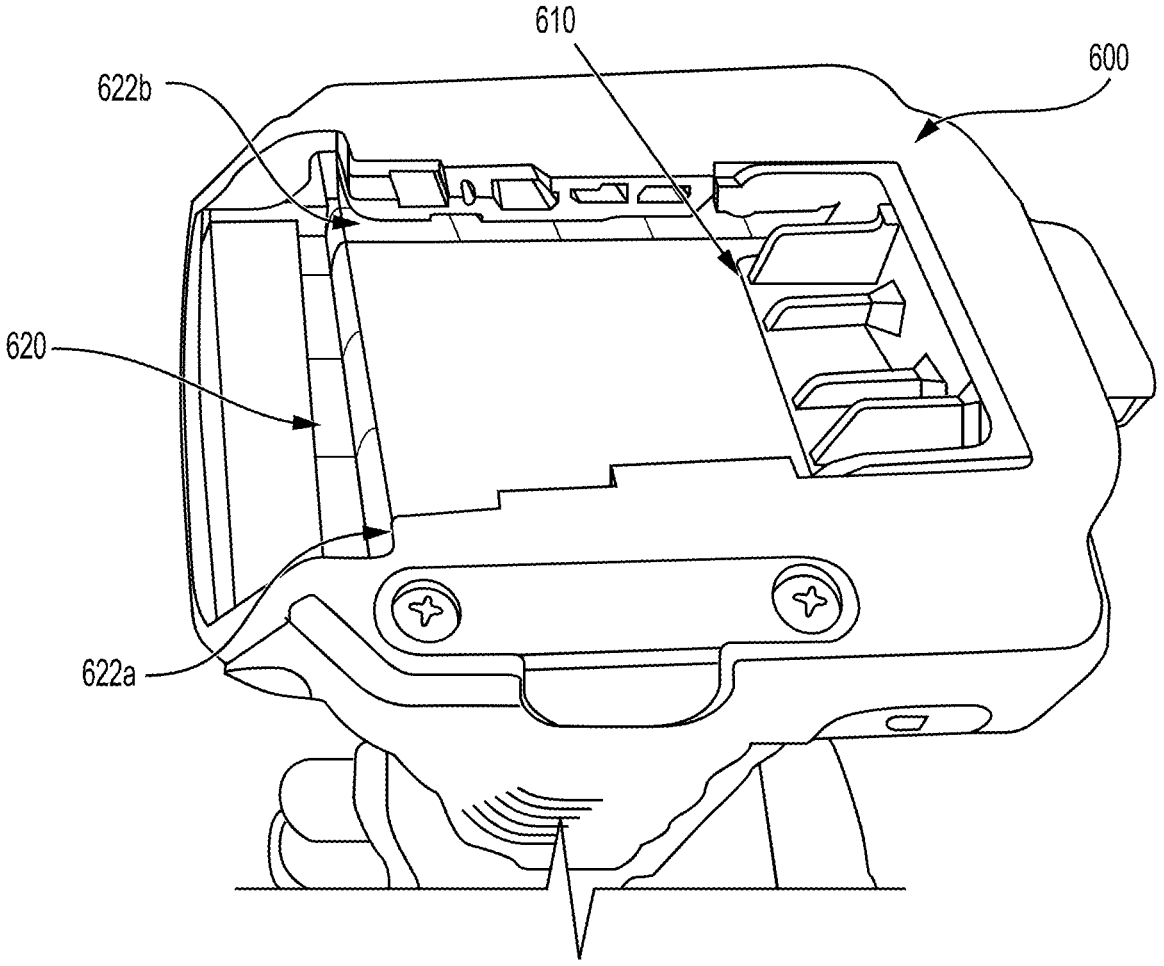
FIG. 12 is bottom perspective view of an exemplary battery receiver slot of a battery powered tool, after the battery has been removed, that may be used in accordance with certain disclosed embodiments of the invention.

FIG. 12 is bottom perspective view of an exemplary battery receiver slot 600 of a battery powered tool, after the battery has been removed, that may be used in accordance with the disclosed embodiments herein. In some embodiments, the battery receiver slot 600 may be configured to receive a removable and rechargeable 20 Volt battery, although other batteries also may be used within the scope of the disclosed embodiments. The battery receiver slot 600 comprises a groove 620 or other recessed region that may run substantially along the width of the battery receiver slot. The battery receiver slot also may comprise a pair of guide channels 622*a* and 622*b* along at least a portion of its side edges.

The guide channels 622*a* and 622*b* may be formed as regions underneath overhanging edges on the sides of the battery receiver slot, for example, as FIG. 12 shows. The guide channels 622*a* and 622*b* may be used to engage with corresponding edges on a battery as the battery is slid into position in the battery receiver slot 600. The battery may be inserted into the battery receiver slot 600 until it makes electrical connections with the metal connectors 610. That is, the metal connectors 610 may block the battery from sliding entirely through the battery receiver slot 600. In the exemplary embodiments disclosed herein, the same guide channels 622*a* and 622*b* may be used to engage with lateral edges 122*a* and 122*b* on a tool mount portion 120. In some embodiments, the tool mount portion 120 similarly may be prevented from sliding within the guide channels 622*a* and 622*b* past the position of the electrical connectors 610.

Figure 13B:
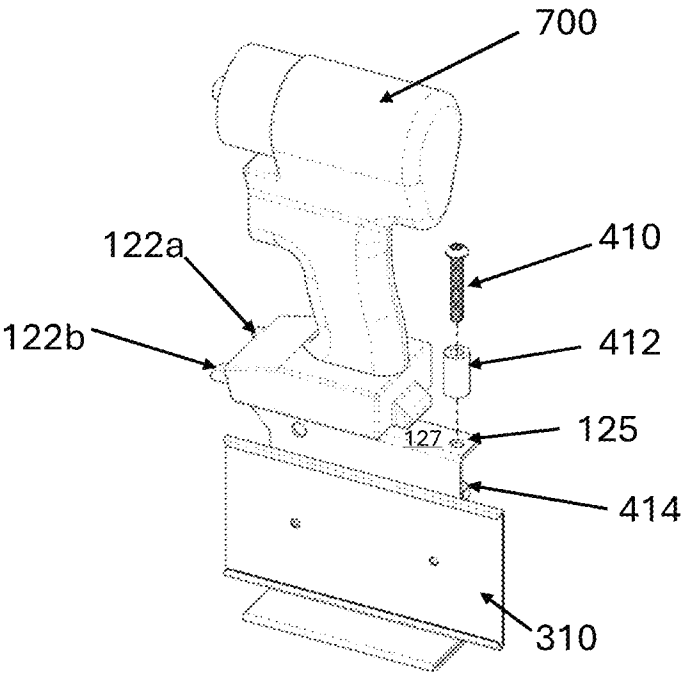
FIG. 13B is a front perspective view showing how an exemplary security screw may be attached behind an exemplary battery powered tool that has been mounted on the security-tool-holder base of FIGS. 2A and 2B, with the price tag channel of FIG. 6 positioned on a front surface of the base, in accordance with certain disclosed embodiments of the invention.
Figure 13A:
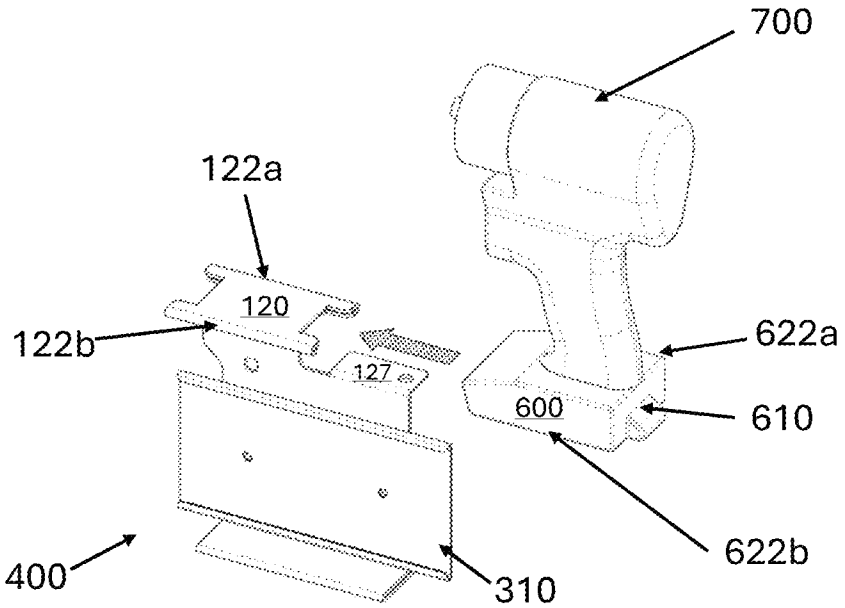
FIG. 13A is a front perspective view showing how a battery receiver slot of an exemplary battery powered tool may be mounted to the exemplary security-tool-holder base of FIGS. 2A and 2B in a first direction, with the exemplary price tag channel of FIG. 6 positioned on a front surface of the base, in accordance with certain disclosed embodiments.
Figure 13C:
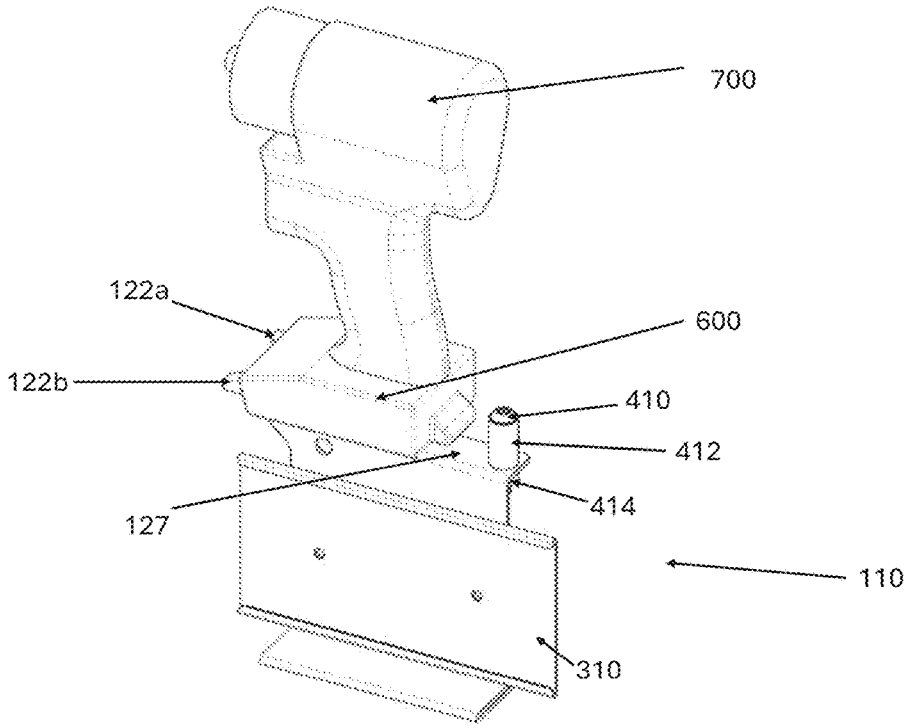
FIG. 13C is a front perspective view of the exemplary security-tool-holder base of FIGS. 2A and 2B, with the exemplary price tag channel of FIG. 6 positioned on a front surface of the base, after an exemplary battery powered tool has been mounted on the base and a security screw has been attached to the base in accordance with certain disclosed embodiments.

FIGS. 13A, 13B, and 13C show how an exemplary battery powered tool 700 may be mounted on the security tool holder 110 in accordance with a first set of disclosed embodiments of the invention. In FIG. 13A, the battery powered tool is slid onto the tool mount portion 120 of the security tool holder. In more detail, the guide channels 622*a* and 622*b* of the battery receiver slot 600 are aligned with the lateral edges 122*a* and 122*b* of the tool mount portion 120 such that the lateral edges 122*a*/122*b* may fit within respective guide channels 622*a*/622*b* on the tool mount portion. The battery powered tool 120 may be slid onto the tool mount portion 120, preferably until at least one of the lateral edges 122*a*/122*b* is blocked from moving further by the electrical connectors 610 or any other physical obstruction in the battery receiver slot.

After the battery powered tool 700 has been slid onto the tool mount portion 120 of the security tool holder 110, the security screw 410 may be connected to the surface 127 of the security tool holder using the spacer 412 and lock nut 414 as shown in FIG. 13B. The security screw 410 extends substantially vertically above the surface 127 to effectively block removal of the battery powered tool 700 if a user attempts to slide the battery power tool 700 off the tool mount portion 120 in a direction opposite from which it was attached. FIG. 13C shows a front perspective view of a final assembly of the exemplary battery power tool 700 securely mounted on the security tool holder 110, including the security screw 410 and price channel 310, for display to a consumer in accordance with a first set of exemplary embodiments.

Figure 14A:
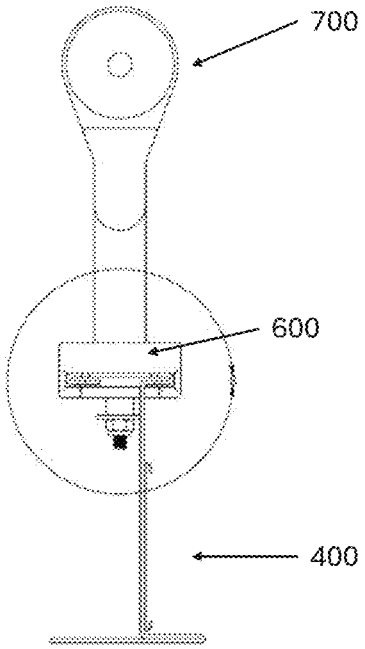
FIG. 14A is side view of the exemplary security-tool-holder base shown in FIGS. 13A-13C after an exemplary battery powered tool has been mounted on the base and a security screw has been attached to the base.
Figure 14B:
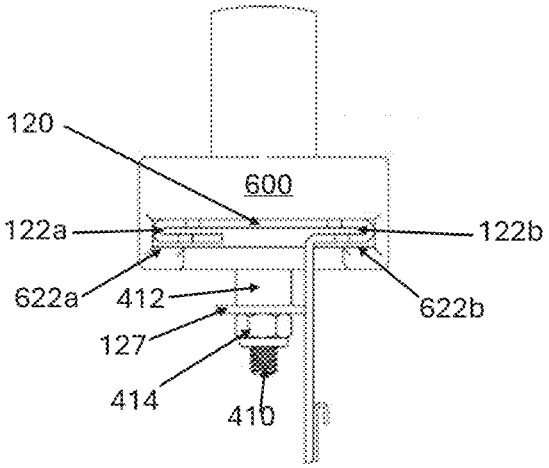
FIG. 14B is a magnified view of the battery receiver slot of the exemplary battery powered tool mounted on the security-tool-holder base shown in FIG. 14A.

FIG. 14A is side view showing the battery power tool 700 mounted on the security tool holder 110 in accordance with the first set of exemplary embodiments. FIG. 14B is a magnified view of FIG. 14A showing that the battery powered tool 700 has been mounted by sliding the lateral edges 122*a*/122*b* on the tool mount portion 120 into corresponding guide channels 622*a*/622*b* in the battery receiver slot 600 of the battery powered tool 700.

Figure 15:
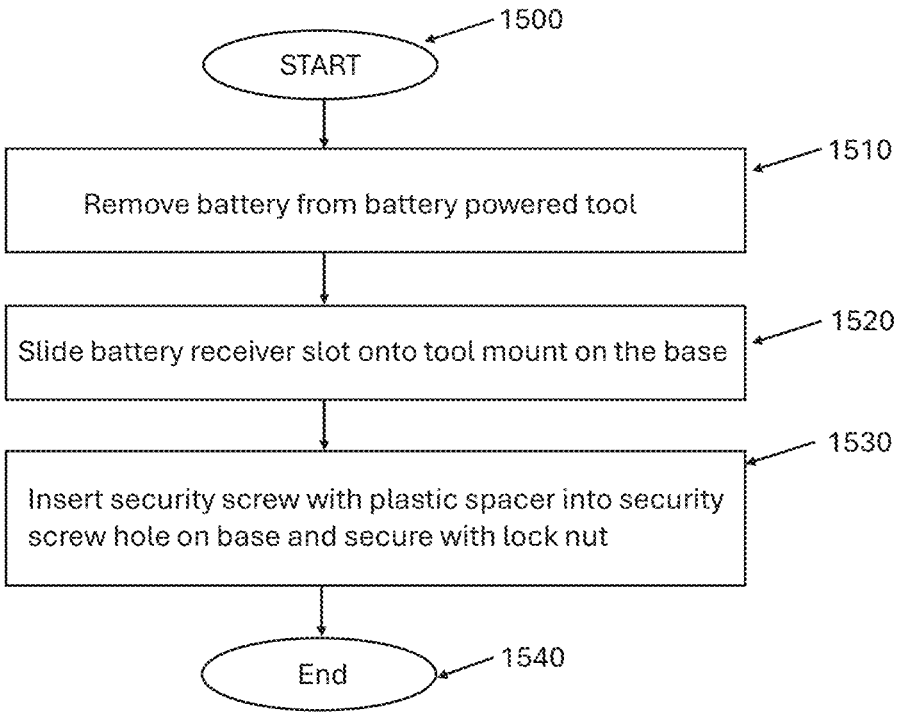
FIG. 15 is a flow chart of an exemplary sequence of steps that may be performed for displaying a battery powered tool on a security tool holder in accordance with the first set of exemplary embodiments of the invention.

FIG. 15 is a flow chart of an exemplary sequence of steps that may be performed for displaying a battery powered tool on a security tool holder in accordance with the first set of exemplary embodiments of the invention. The sequence starts at step 1500 and proceeds to step 1510 where the battery is removed from the battery powered tool 700, such as a drill, ratchet, grinder, saw, router, sander, or the like. At step 1520, the battery receiver slot 600 of the battery powered tool is slid onto the tool mount portion 120 of the base of the security tool holder 110. The bottom of the security tool holder may be attached to a merchandise display system, such as by inserting screws, bolts, or other fasteners through the holes 130 and 132 on the bottom surface of the security tool holder and through corresponding holes in the display system.

After the battery powered tool 700 is mounted on the base of the security tool holder 110, then at step 1530 a security screw 410 with a plastic spacer 412 is attached to the base through a hole 125 and secured with a lock nut 414. The security screw 410 is positioned behind the battery power tool 700 to prevent a user from sliding the battery power tool off of the tool mount portion 120 of the security tool holder 110. The sequence ends at step 1540.

Figure 16:
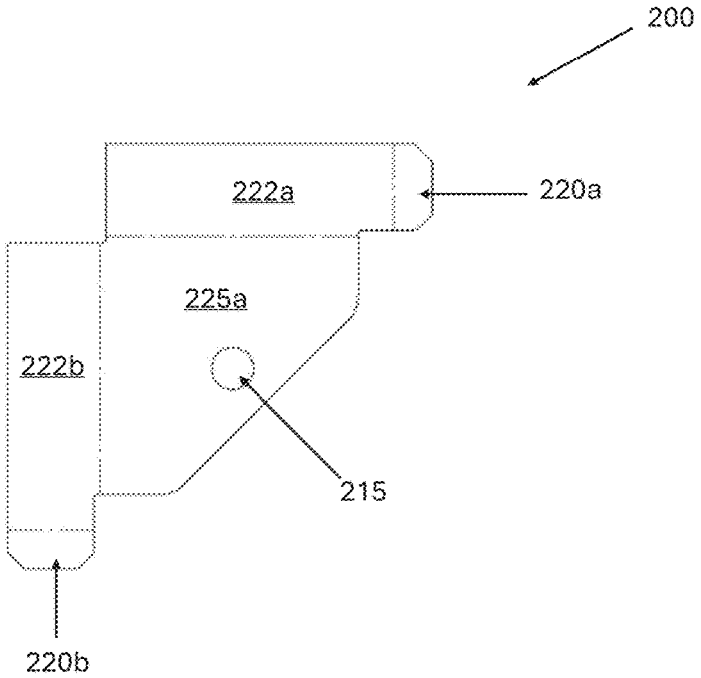
FIG. 16 is a top view of an exemplary shape that may be cut from a sheet of material to form a lock bracket for a security tool holder in accordance with certain disclosed embodiments of the invention.

A second set of exemplary embodiments is described with reference to FIGS. 16-25. FIG. 16 shows an example of a two-dimensional shape 200 corresponding to a lock bracket 210 that may be cut out from a sheet of material, such as steel, aluminum, or another metal or alloy. The two-dimensional shape 200 may be cut from a sheet of metal using a metal cutting machine, such as using a laser cutter or other cutting apparatus, or alternatively may be formed using additive or subtractive processes and other materials known in the art.

The two-dimensional shape 200 includes a front surface 225*a* and a back surface 225*b* with a hole 215 therethrough. The hole 215 may be formed using cutting, punching, etching, and/or any other means known in the art for creating such holes through the thickness of the material. The two-dimensional shape 200 also includes a generally rectangular first portion 220*a* with a first tab area 220*a* at its distal end; the shape 200 further includes a generally rectangular second portion 220*b* with a second tab area 220*b* at its distal end. In this example, the lengths of the generally rectangular first and second portions 222*a* and 222*b* are oriented substantially perpendicular relative to each other.

Figure 17:
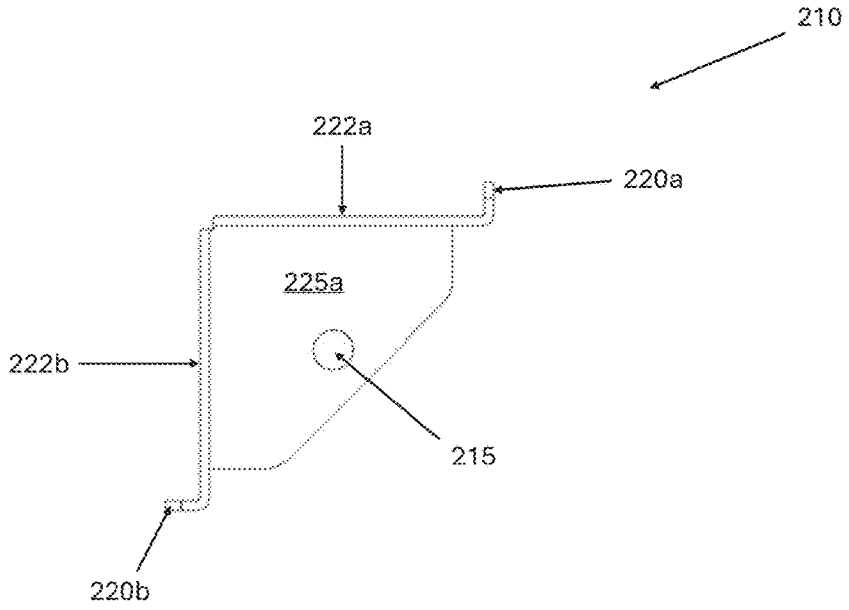
FIG. 17 is side view of an exemplary lock bracket that may be used in accordance with certain disclosed embodiments of the invention.
Figure 18B:
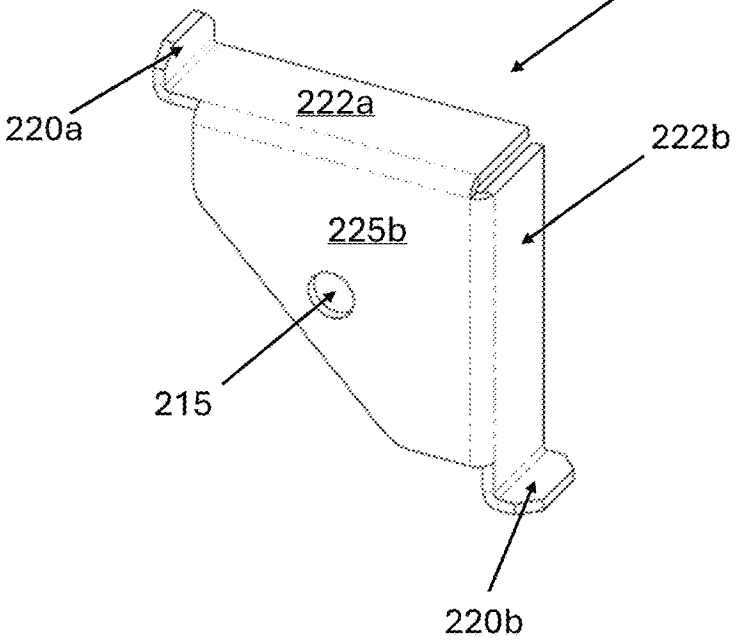
FIGS. 18A and 18B are front and back perspective views, respectively, of the exemplary lock bracket of FIG. 17.
Figure 18A:
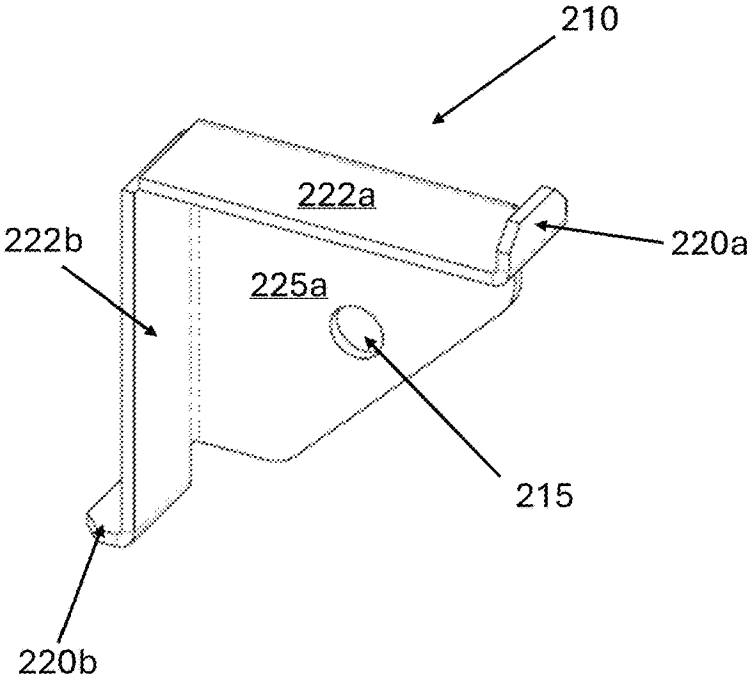

In FIG. 17, the two-dimensional shape 200 may be mechanically bent along each of the dashed horizontal and vertical lines, thereby bending each of the first portion 222*a* and second portion 222*b* in the same direction toward the front surface 225*a*, and also bending the first and second tab areas 220*a* to protrude substantially perpendicular from their respective first and second portions 222*a* and 222*b*, to form the three-dimensional lock bracket 210 shown in FIGS. 17, 18A, and 18B. The bent first and second tab areas may provide first and second tabs 220*a* and 220*b* that are configured to fit within a groove 620 of a battery receiver slot 600 in a battery powered tool. For instance, in the second set of exemplary embodiments, at least one of the first and second tabs 220*a* and 220*b* may be shaped and sized to extend sufficiently into the depth of the groove 620 to prevent the battery powered tool 700 from being removed from the tool mount portion 120 after the battery powered tool has been mounted onto the tool mount portion.

Figure 19A:
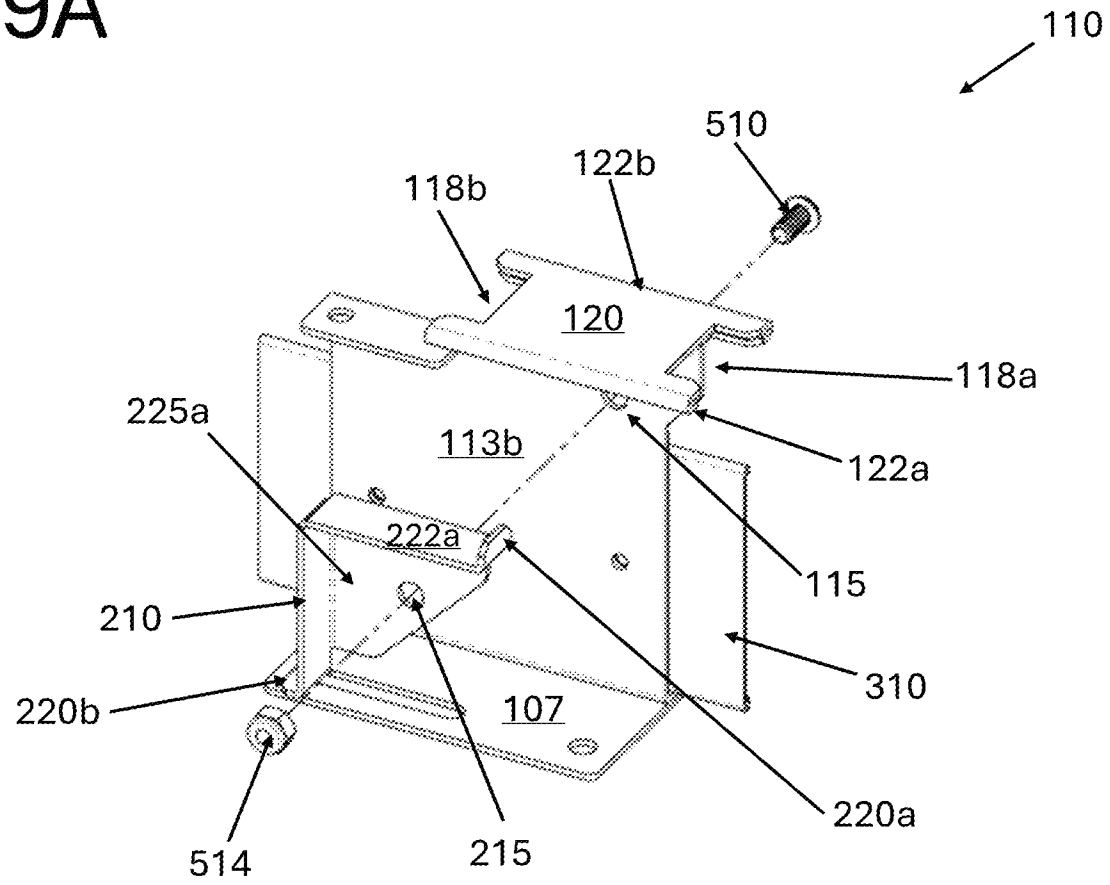
FIG. 19A is a back perspective view of the security-tool-holder base of FIGS. 2A and 2B, with the price tag channel of FIG. 6 positioned on a front surface of the base, showing how the exemplary lock bracket of FIGS. 18A and 18B may be attached in a first exemplary orientation to a back surface of the security-tool-holder base in accordance with certain disclosed embodiments of the invention.
Figure 19B:
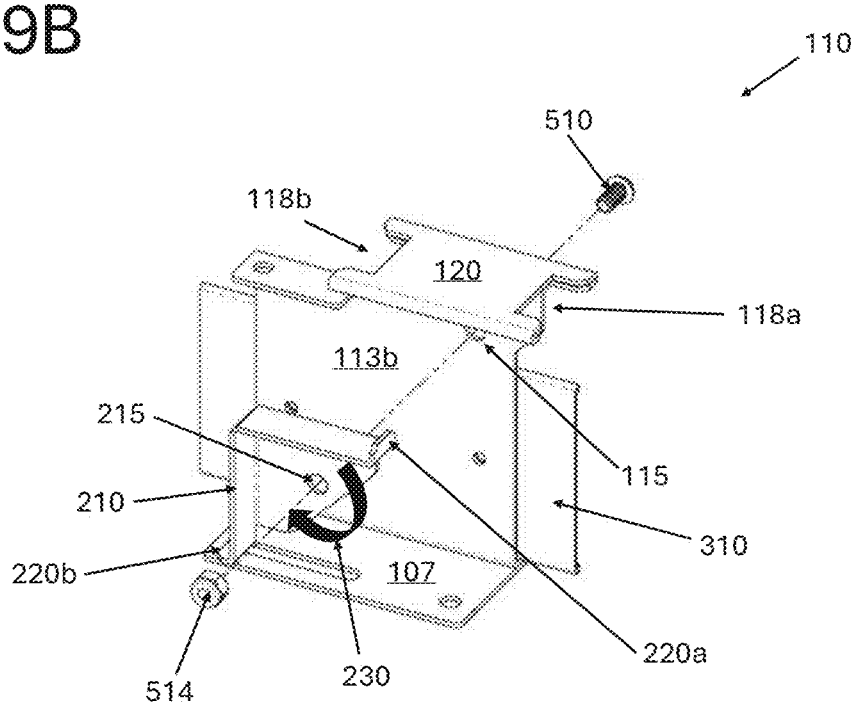
FIG. 19B is a back perspective view of the security-tool-holder base of FIGS. 2A and 2B, with the price tag channel of FIG. 6 positioned on a front surface of the base, showing how the exemplary lock bracket of FIGS. 18A and 18B may be rotated to a second exemplary orientation and attached to a back surface of the security-tool-holder base in accordance with certain disclosed embodiments.

FIG. 19A shows how the exemplary lock bracket 210 may be attached to a back surface 113*b* of the security tool holder 110 of FIGS. 2A and 2B. First, the hole 215 in the lock bracket 210 is aligned with a hole 115 on the back surface 113*b* of the security tool holder. A screw 510, such as a security screw, may be inserted through the aligned holes 115 and 215 and secured with a lock nut 514. As shown in FIG. 19A, the lock bracket 210 may be oriented such that its first tab 220*a* is configured to extend into the first open area 118*a* in the tool mount portion 120 of the security tool holder 110. FIG. 19B shows that the lock bracket 210 alternatively may be rotated, such as by a clockwise rotation 230, so it is instead oriented with its second tab 220*b* configured to extend into the second open area 118*b* in the tool mount portion 120. The lock bracket 210 therefore may be pivotally rotated about the aligned holes 115 and 215 until it is positioned in a desired orientation and then secured into place using the screw 510 and nut 514.

Figure 20A:
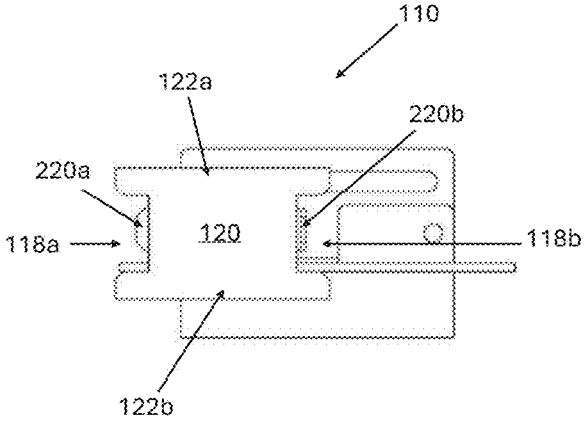
FIG. 20A is a top view of the exemplary security-tool-holder base of FIGS. 2A and 2B including the exemplary lock bracket of FIGS. 18A and 18B connected to the base in a first orientation in accordance with certain disclosed embodiments of the invention.
Figure 20B:
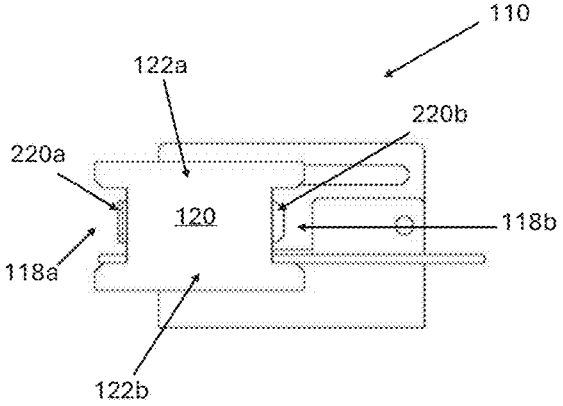
FIG. 20B is a top view of the exemplary security-tool-holder base of FIGS. 2A and 2B including the exemplary lock bracket of FIGS. 18A and 18B connected to the base in a second orientation in accordance with certain disclosed embodiments of the invention.
Figure 21:
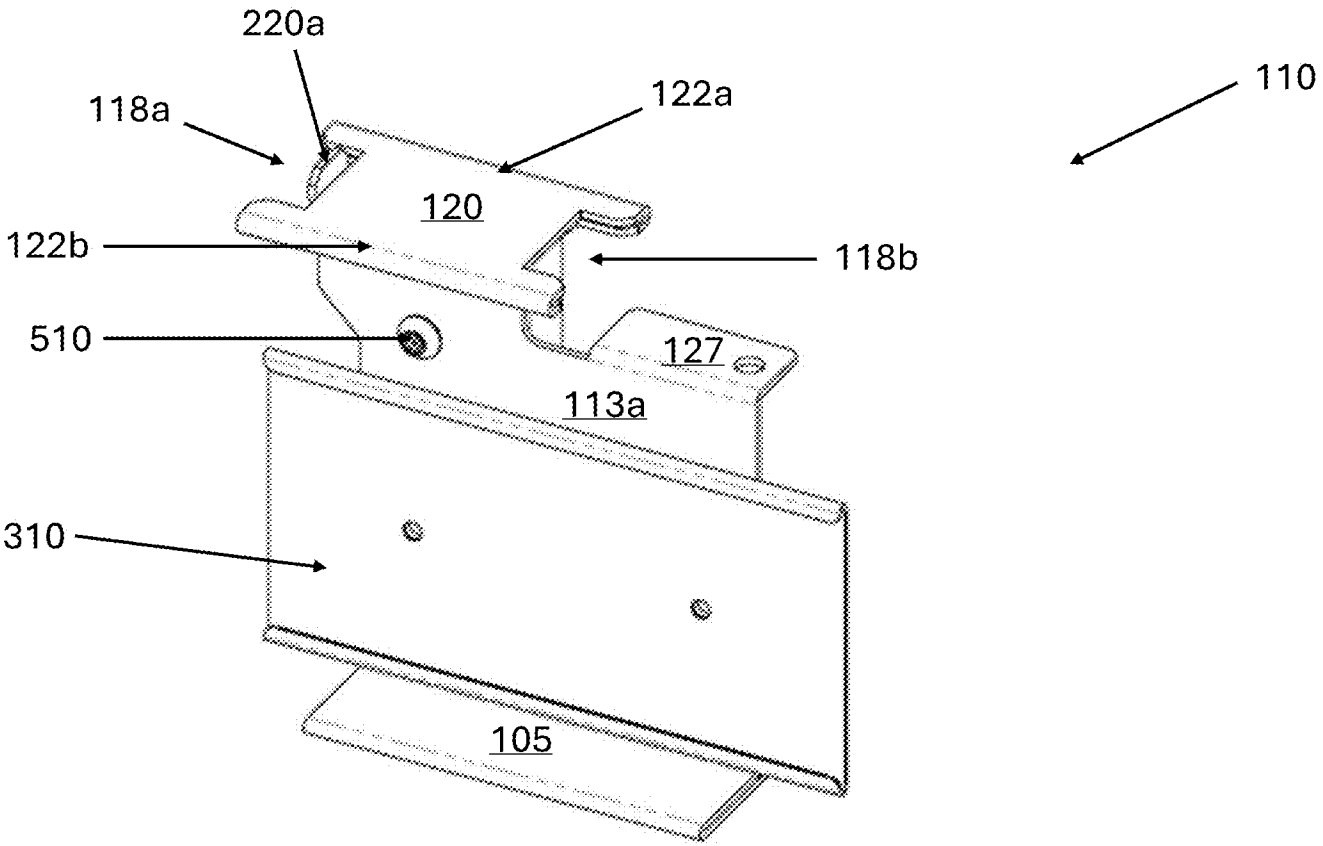
FIG. 21 is a front perspective view of the exemplary security-tool-holder base of FIGS. 2A and 2B including the exemplary lock bracket of FIGS. 18A and 18B connected to a back surface of the base in a first orientation in accordance with certain disclosed embodiments.

FIGS. 20A and 20B show a top view of the security tool holder 110 with an attached lock bracket 210 secured in different orientations. In FIG. 20A, the lock bracket 210 is attached so that its first tab 220*a* extends upward through the first open area 118*a*. FIG. 20B shows the lock bracket 210 attached with its second tab 220*b* extending upward through the second open area 118*b*. FIG. 21 shows a front perspective view of the lock bracket 210 attached according to its configuration in FIG. 20A. As FIG. 21 shows, the lock bracket 210 is substantially visually hidden from view of a user facing the front surface 113*a* of the security tool holder 110. Because the screw 510 is preferably a security screw with a specialized bit pattern to install and remove, a user facing the security tool holder cannot easily remove the lock bracket 210 attached thereon.

Figure 22B:
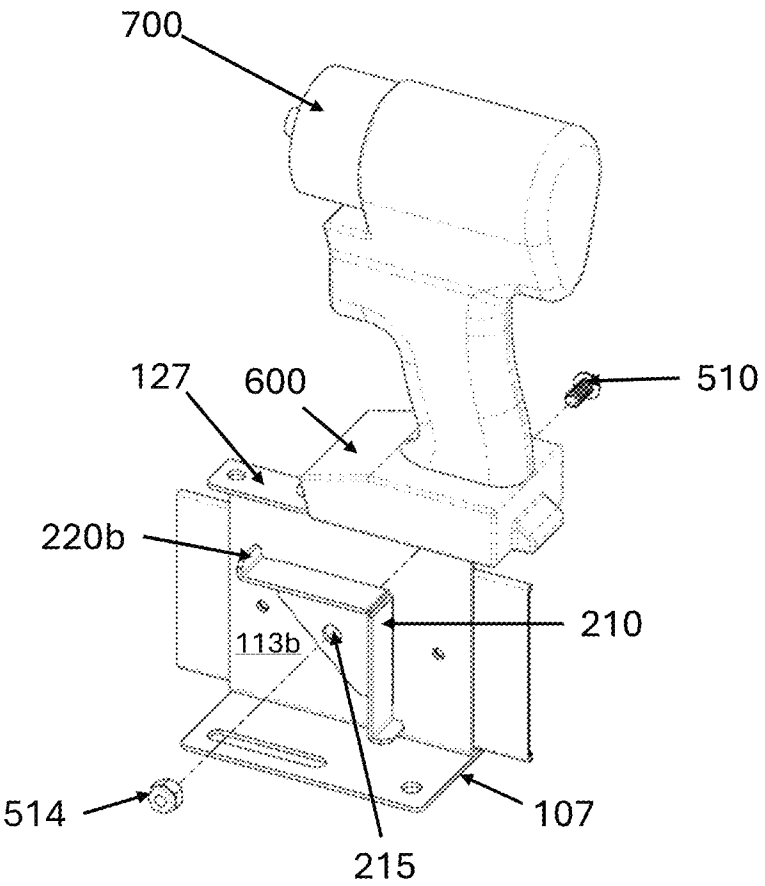
FIG. 22B is a back perspective view showing how the exemplary lock bracket of FIGS. 18A and 18B may be attached in a first orientation to the security-tool-holder base of FIGS. 2A and 2B, with the price tag channel of FIG. 6 on a front surface of the base, after a battery powered tool has been mounted on the base in accordance with certain disclosed embodiments.
Figure 22A:
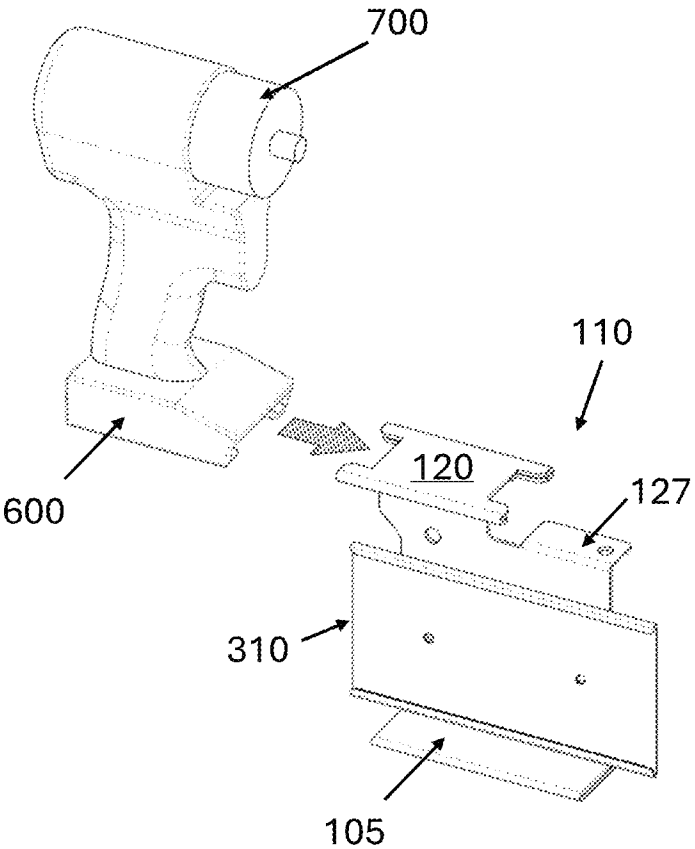
FIG. 22A is a front perspective view showing how a battery receiver slot of an exemplary battery powered tool may be mounted to the security-tool-holder base of FIGS. 2A and 2B in a second direction, with the price tag channel of FIG. 6 positioned on a front surface of the base, in accordance with certain disclosed embodiments.

FIGS. 22A-D show how an exemplary battery powered tool 700 may be mounted on the security tool holder 110 in accordance with a second set of disclosed embodiments of the invention. In FIG. 22A, the battery powered tool is slid onto the tool mount portion 120 of the security tool holder. For example, the guide channels 622*a* and 622*b* of the battery receiver slot 600 may be aligned with the lateral edges 122*a* and 122*b* of the tool mount portion 120 such that the lateral edges 122*a*/122*b* may fit within respective guide channels 622*a*/622*b* on the tool mount portion. The battery powered tool 120 may be slid onto the tool mount portion 120, preferably until at least one of the lateral edges 122*a*/122*b* is blocked from moving further by the electrical connectors 610 or any other physical obstruction in the battery receiver slot.

In the second set of exemplary disclosed embodiments, the battery powered tool 700 may be mounted onto the tool mount portion 120 of the security tool holder 110 in multiple configurations. For example, in FIG. 22A the battery powered tool 700 may be slid onto the tool mount portion 120 in a first direction, e.g., where the battery powered tool faces towards a security screw mount surface 127. Alternatively, the battery powered tool 700 may be slid onto the tool mount portion 120 in a second direction, e.g., an opposite direction, where the battery powered tool faces away from the surface 127. Further, in the second set of disclosed embodiments, the surface 127 (and its hole 125) and first and second open areas 118*a* and 118*b* are not used and are therefore may be omitted from the security tool holder 110 in some embodiments. Likewise, in the first set of disclosed embodiments, the lock-bracket hole 115 for securing a lock bracket 210 is not used and may be omitted from the security tool holder 110.

After the battery powered tool 700 has been mounted onto the tool mount portion 120 of the security tool holder 110 as shown in FIG. 22A, the exemplary lock bracket 210 may be attached to the back surface 113*b* of the security tool holder, for example, as shown in FIG. 22B with the second tab 220*b* of the lock bracket 210 aligned to fit within the second open area 118*b* on the tool mount portion 120 and extend into a groove 620 in the battery receiver slot 600 of the battery powered tool 700. In this exemplary embodiment, the groove 620 is positioned above the open area 118*b* in a manner that allows the second tab 220*b* to extend through the open area 118*b* and into the groove 620. More generally, when the battery powered tool 700 has been mounted on the tool mount portion 120 in a first direction, the open area 118*b* of the tool mount portion may align with the groove 620 in the battery receiver slot 600; alternatively, when the battery powered tool 700 has been mounted on the tool mount portion 120 in a second direction, the open area 118*a* of the tool mount portion aligns with the groove 620. In either case, the insertion of either the first tab 220*a* or the second tab 220*b* into the groove 620 prevents a user from sliding the battery powered tool 700 off of the tool mount portion 120.

Figure 22D:
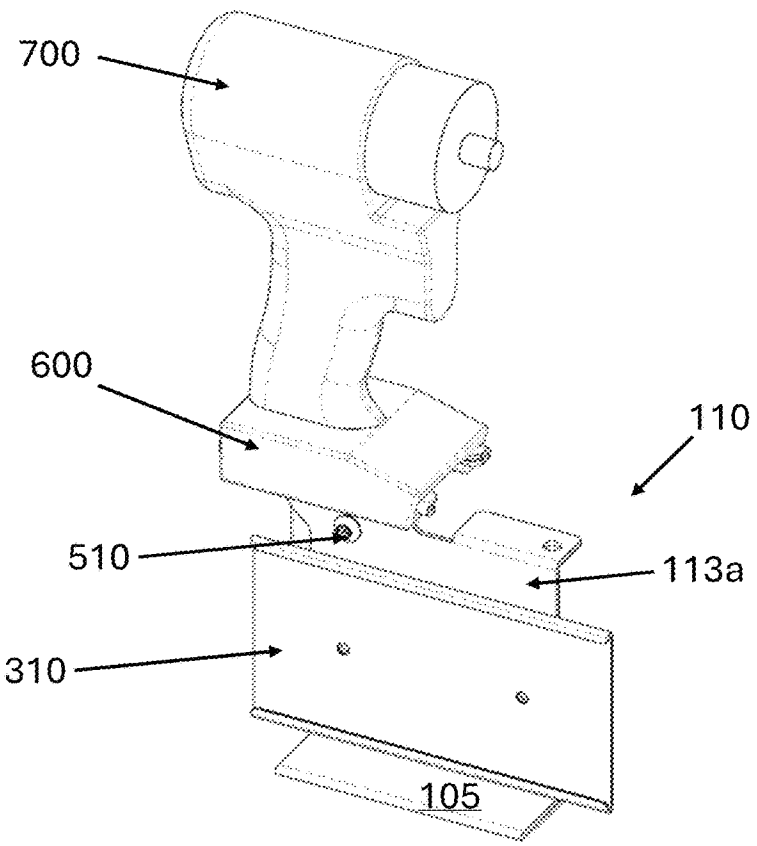
FIG. 22D is a front perspective view of the exemplary battery powered tool mounted to the security-tool-holder base of FIGS. 2A and 2B, with the exemplary price tag channel of FIG. 6 positioned on a front surface of the base, in accordance with certain disclosed embodiments.
Figure 22C:
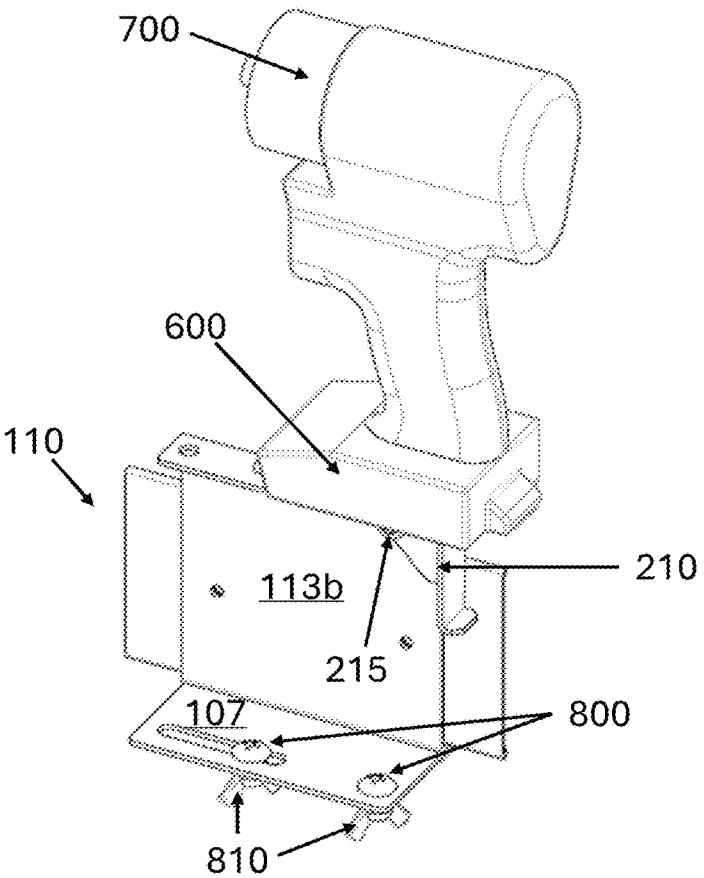
FIG. 22C is a back perspective view of the exemplary battery powered tool mounted to the security-tool-holder base of FIGS. 2A and 2B, with the exemplary price tag channel of FIG. 6 positioned on a front surface of the base, in accordance with certain disclosed embodiments.

FIG. 22C shows a back perspective view of the exemplary battery powered tool 700 mounted on the tool mount portion 120 of the security tool holder 110 after the lock bracket 210 has been securely attached with its second tab 220*b* seated in the groove 620 of the battery receiver slot 600. FIG. 22C further shows that the bottom surface 107 of the security tool holder 110 may be secured to a merchandise display system using, for example, screws 800 and wing nuts 810 (or other fasteners) applied through one or more of the holes 130 and 132 in the bottom surface 107. FIG. 22D shows a front perspective view of a final assembly of the exemplary battery power tool 700 securely mounted on the security tool holder 110, including the security screw 510 and price channel 310, for display to a consumer in accordance with a second set of exemplary embodiments.

Figure 23A:
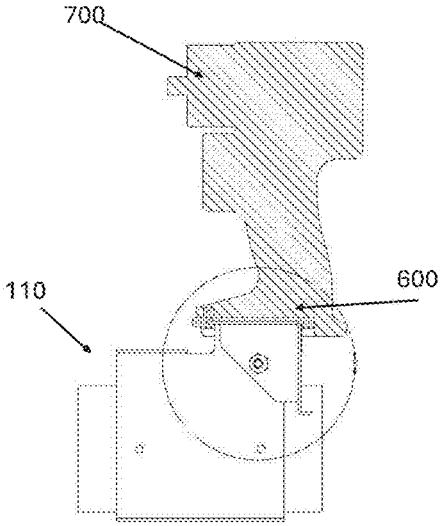
FIG. 23A is side cross-sectional view of the exemplary lock bracket of FIGS. 18A and 18B connected to the security-tool-holder base of FIGS. 2A and 2B such that a tab on the lock bracket is positioned within a groove in a battery receiver slot of an exemplary battery powered tool that has been mounted on the base in accordance with certain disclosed embodiments.
Figure 23B:
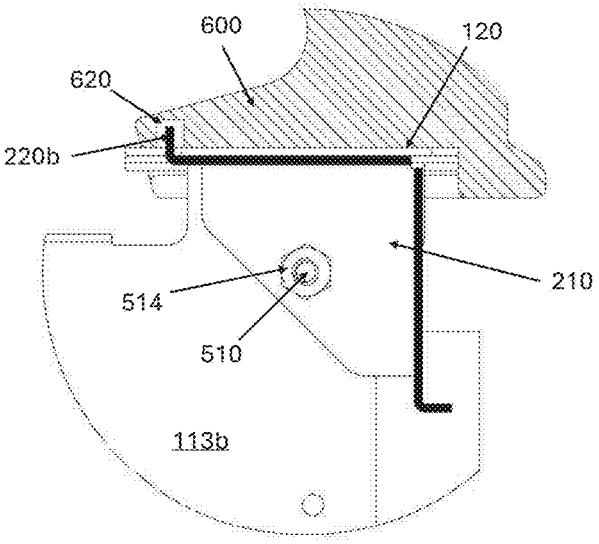
FIG. 23B is a magnified view of the side cross-sectional view in FIG. 23A showing an exemplary tab on the lock bracket of FIGS. 18A and 18B positioned within a groove in a battery receiver slot of an exemplary battery powered tool mounted on the base in accordance with certain disclosed embodiments.

FIG. 23A is side cross-sectional view of the exemplary lock bracket 210 connected to the security tool holder 110 with its second tab 220*b* positioned within the groove 620 of the battery receiver slot 600 on the battery powered tool 700. FIG. 23B is a magnified view of the side cross-sectional view in FIG. 23A. As FIG. 23B shows, the second tab 220*b* in this example extends sufficiently into the groove 620, substantially perpendicular from the top surface of the tool mount portion 120, to effectively create a barrier that prevents a user from sliding the battery powered tool 700 off of the tool mount portion.

Figure 24A:
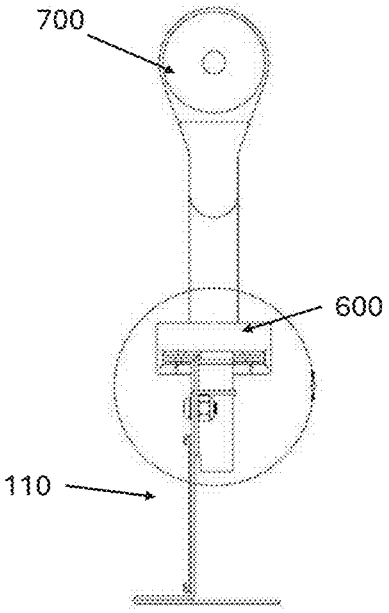
FIG. 24A is side view of the exemplary security-tool-holder base shown in FIGS. 23A and 23B after an exemplary battery powered tool has been mounted on the base and secured using the exemplary lock bracket of FIGS. 18A and 18B.
Figure 24B:
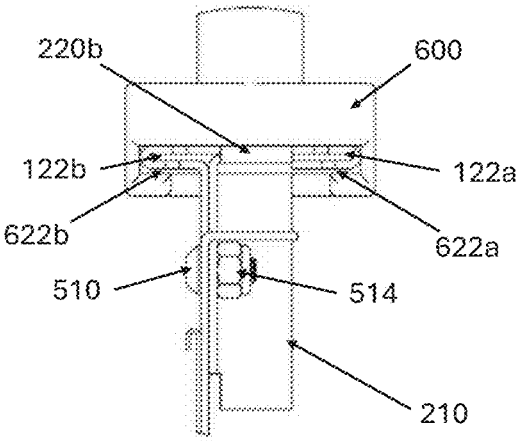
FIG. 24B is a magnified view of the battery receiver slot of the exemplary battery powered tool mounted on the security-tool-holder base shown in FIG. 24A.

FIG. 24A is side view showing the battery power tool 700 mounted on the security tool holder 110 in accordance with the second set of exemplary embodiments. FIG. 24B is a magnified view of FIG. 24A showing that the battery powered tool 700 has been mounted by sliding the first and second lateral edges 122*a*/122*b* on the tool mount portion 120 into corresponding first and second guide channels 622*a*/622*b* in the battery receiver slot 600 of the battery powered tool 700. FIG. 24B further depicts the second tab 220*b* extending substantially vertically through an open area 118*b* and into the battery receiver slot 600.

Figure 25:
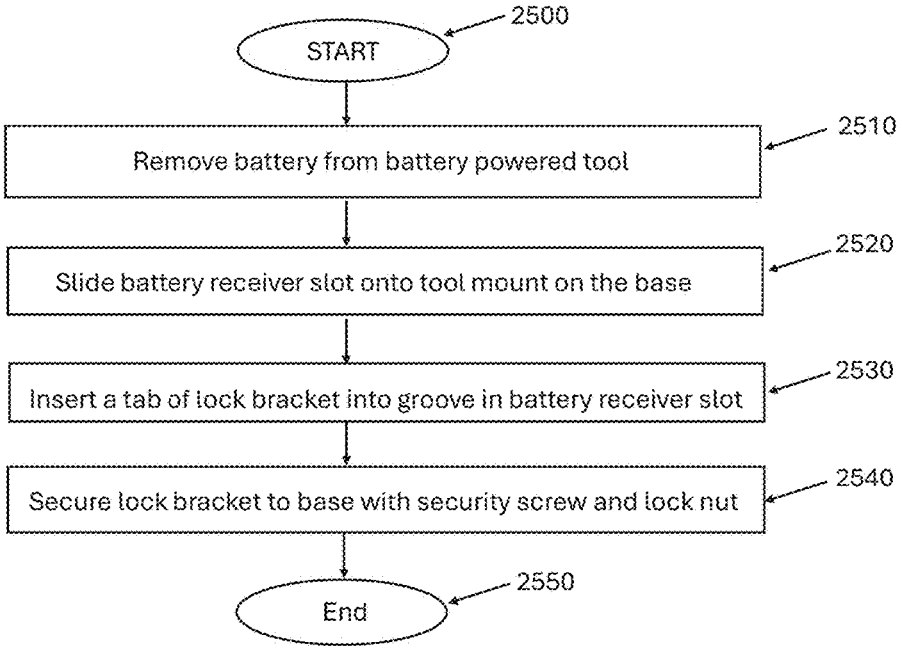
FIG. 25 is a flow chart of an exemplary sequence of steps that may be performed for displaying a battery powered tool on a security tool holder in accordance with the second set of exemplary embodiments of the invention.

FIG. 25 is a flow chart of an exemplary sequence of steps that may be performed for displaying a battery powered tool on a security tool holder in accordance with the second set of exemplary embodiments of the invention. The sequence starts at step 2500 and proceeds to step 2510 where the battery is removed from the battery powered tool 700, such as a drill, ratchet, grinder, saw, router, sander, or the like. At step 2520, the battery receiver slot 600 of the battery powered tool is slid onto the tool mount portion 120 of the base of the security tool holder 110. The bottom of the security tool holder may be attached to a merchandise display system, such as by inserting screws 800 and/or bolts or other fasteners through the holes 130 and 132 on the bottom surface of the security tool holder and through corresponding holes in the display system.

After the battery powered tool 700 is mounted on the base of the security tool holder 110, then at step 2530 the lock bracket 210 may be positioned adjacent to a surface of the security tool holder so that a hole 215 in the lock bracket and a hole 115 in the base of the security tool holder 110 are aligned and at least one of the first and second tabs 220*a*/220*b* on the lock bracket 210 is inserted through an open area 118*a*/118*b* in the tool mount portion 120 of the security tool holder and into a groove 620 of a battery receiver slot 600 on the battery powered tool 700. After positioning the lock bracket at step 2530, a security screw 510 may be inserted through the aligned holes 115 and 215 and secured using a lock nut 514 at step 2540. The secured lock bracket 210, with its first tab 220*a* or second tab 220*b* seated within the groove 620 of the battery receiver slot 600 prevents a user from sliding the battery power tool 700 off of the tool mount portion 120 of the security tool holder 110. The sequence ends at step 2550.

Figure 26C:
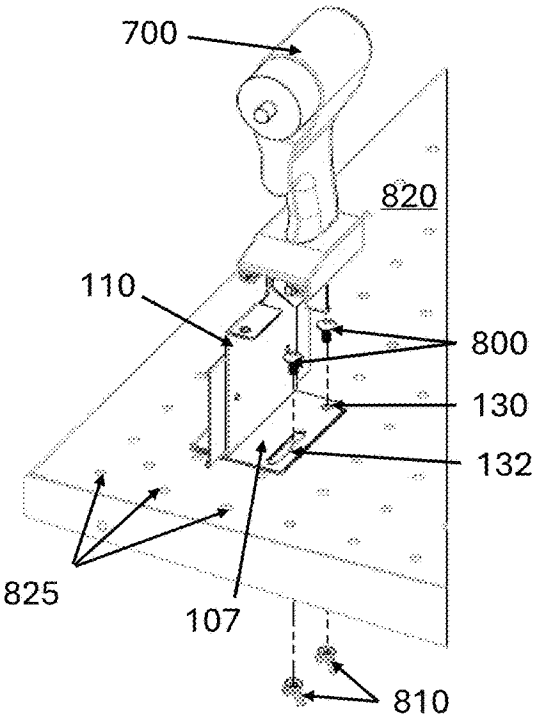
FIG. 26C is a side perspective view showing how the security-tool-holder base of FIGS. 2A and 2B with an exemplary battery power tool displayed thereon may be attached to a merchandise display system in accordance with certain exemplary embodiments of the invention.
Figure 26B:
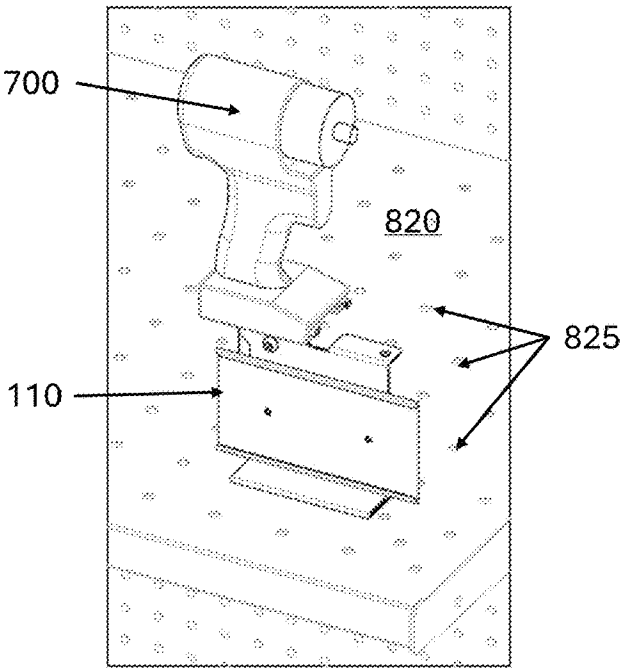
FIG. 26B is a magnified front perspective view of the security-tool-holder base of FIGS. 2A and 2B with an exemplary battery power tool displayed thereon using the exemplary lock bracket of FIGS. 18A and 18B, and the exemplary price tag channel of FIG. 6 positioned on a front surface of the base, attached to a shelf of the merchandise display system in accordance with the second set of exemplary embodiments of the invention.
Figure 26A:
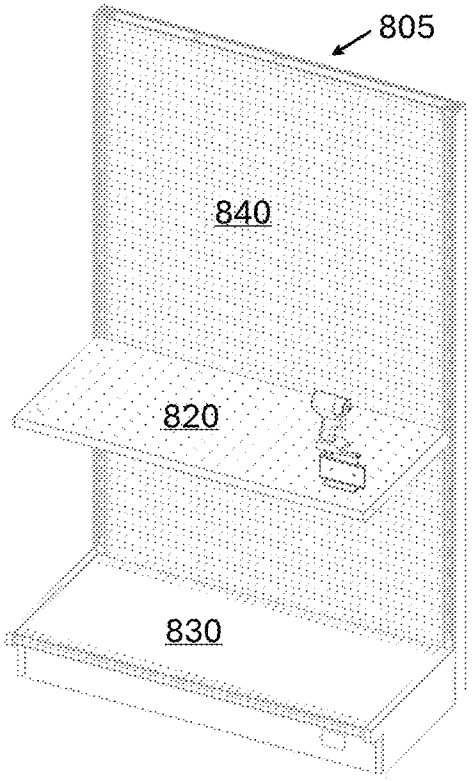
FIG. 26A is a front perspective view of a merchandise display system comprising the exemplary battery powered tool mounted to the security-tool-holder base of FIGS. 2A and 2B using the exemplary lock bracket of FIGS. 18A and 18B, with the exemplary price tag channel of FIG. 6 positioned on a front surface of the base, attached to a shelf of the merchandise display system in accordance with the second set of exemplary embodiments of the invention.

FIG. 26A shows an exemplary merchandise display system 805 comprising at least one shelf 820, bottom surface 830, and back surface 840. One or more of the shelf 820, bottom surface 830, back surface 840 may comprise one or more holes 825 that may be used to attach the exemplary security tool holder 110 to the merchandise display system consistent with any of the disclosed embodiments. To illustrate, for example, FIGS. 26A, 26B, and 26C illustrate a security tool holder 110 configured according to the second set of disclosed embodiments attached to the shelf 820. In this example, the shelf 820 comprises a plurality of holes 825. A hole 130 in the bottom surface 107 of the security tool holder 110 may be aligned with one of the holes 825 on the shelf 820, and the elongated slot 132 in the bottom surface 107 may overlap at least one additional hole 825 on the shelf 820. As FIG. 26C shows, a pair of screws 800, such as security screws (or other fasteners), may be inserted through aligned holes 130/825 and 132/825 and secured with corresponding wing nuts 810 (or other types of nuts).

Preferably, the wing nuts 810 positioned underneath the shelf 820 may only be accessed by store employees via a security cage or other locked area that encloses the wing nuts and is not accessible to customers. The security cage or other locked area preferably requires store employees to use a physical locking mechanism, such as a key lock, combination lock, or other lock, to access the nuts 810 used to secure the security tool holder 110 to the shelf 820.

While the first and second sets of disclosed embodiments have been described simply for purposes of example and explanation, other embodiments of the present invention are also possible. For example, in a third set of exemplary embodiments, the open areas 118*a* and 118*b* formed at the edges of the tool mount portion 120 of the security tool holder 110, e.g., as concave regions along the edges, instead may be formed as fully-enclosed open areas (openings) located entirely within the interior of the top surface of the tool mount portion 120. In such alternative embodiments, either of the first tab 220*a* or second tab 220*b* of the lock bracket 210 may extend through one of the fully-enclosed openings in the tool mount portion 120 and into the groove 620 of the battery receiver slot 600 as previously described above in connection with the second set of exemplary embodiments.

Figure 27:
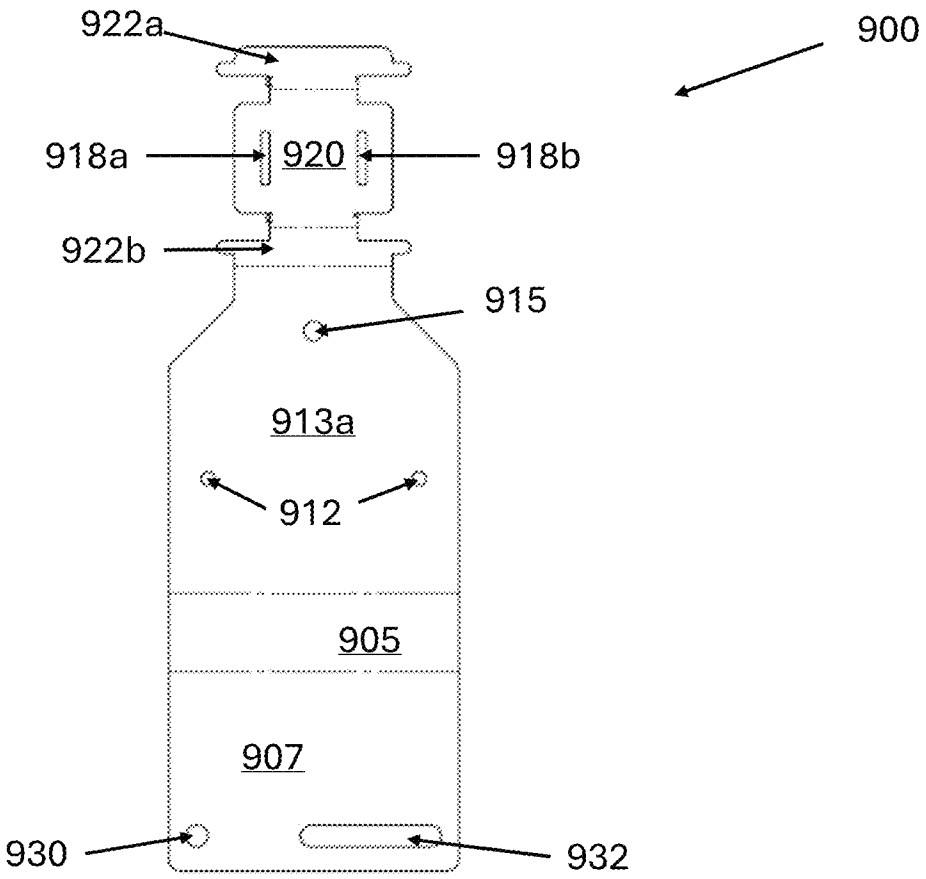
FIG. 27 is a top view of an exemplary shape that may be cut from a sheet of material to form a base of a security tool holder in accordance with a third set of exemplary embodiments of the invention.
Figure 28:
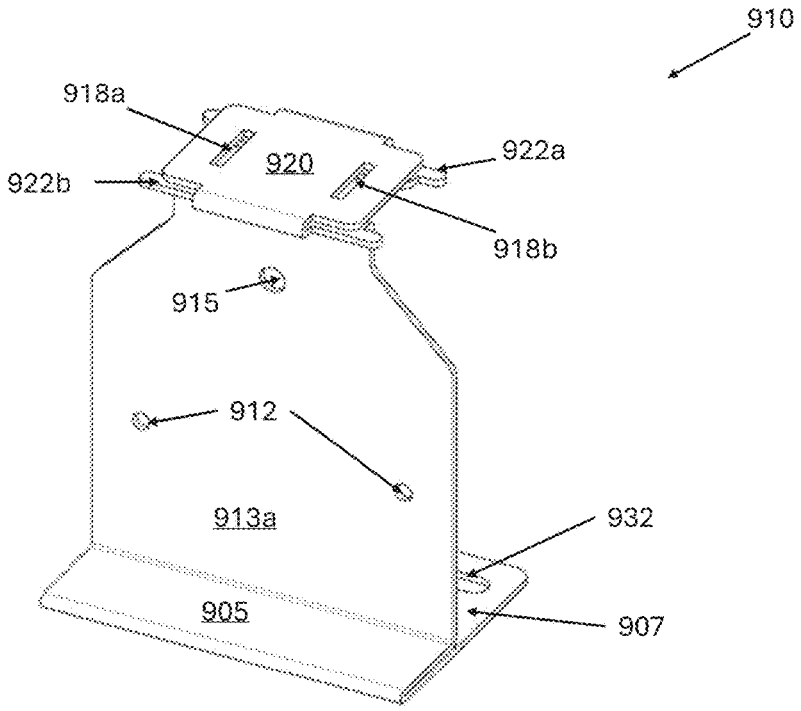
FIG. 28 is a front perspective view of an exemplary base of a security tool holder that may be used in accordance with the third set of exemplary embodiments of the invention.
Figure 29:
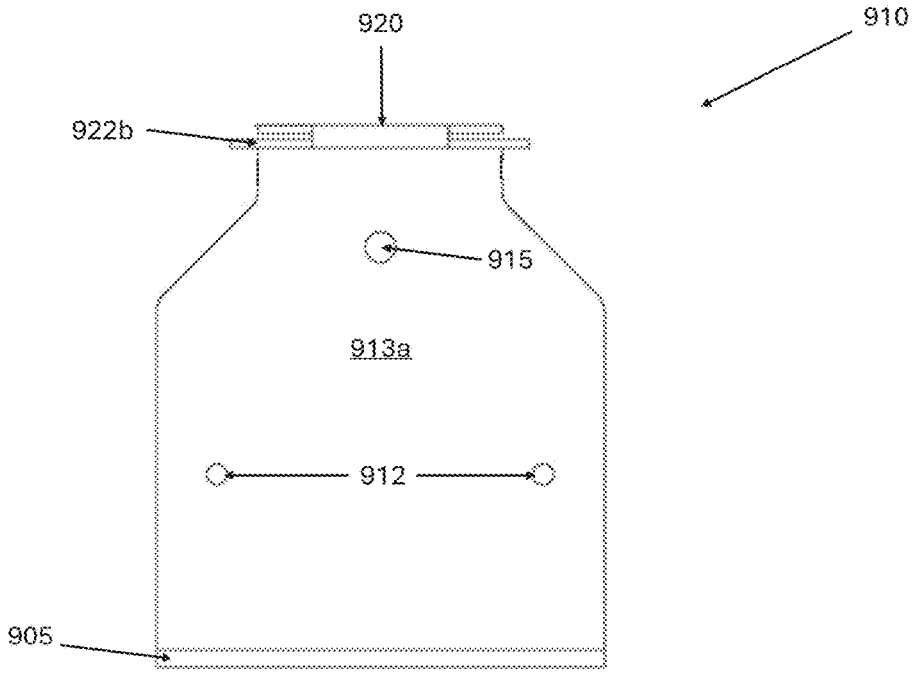
FIG. 29 is a side perspective view of the exemplary base of a security tool holder shown in FIG. 28.

FIGS. 27-29 further illustrate an example of one possible embodiment of an alternative security tool holder 910 in which the tool mount portion 920 includes fully-enclosed open areas 918*a* and 918*b* having the same functionality as the open areas 118*a* and 118*b* in the second set of disclosed embodiments in FIGS. 16-25.

FIG. 27 is a top view of an exemplary two-dimensional shape 900 that may be cut from a sheet of material to form a base of a security tool holder in accordance with a third set of exemplary embodiments of the invention. For example, the outline of shape 900 may be cut from a sheet of metal using a metal cutting machine, such as using a laser cutter or other cutting apparatus, or alternatively may be formed using additive or subtractive processes and other materials known in the art. The shape 900 includes holes 912, 915, 930, and 932 therethrough, which may be formed using cutting, punching, etching, and/or any other means known in the art for creating such holes through the thickness of the material.

In the two-dimensional shape 900 in FIG. 9, the holes 912, 915, 930, and 932 may serve the same functions as the holes 112, 115, 130, and 132 in the first and second disclosed embodiments described above. Similarly, the regions 905, 907, 913*a*, 920, 922*a*, and 922*b* shown in FIG. 9 may serve the same respective functions as regions 105, 107, 113*a*, 120, 122*a*, and 122*b* in the first and second disclosed embodiments described above.

In FIG. 28, the two-dimensional shape 900 may be mechanically bent along each of the dashed horizontal lines to form the three-dimensional security tool holder 910 illustrated in FIGS. 28 and 29. FIG. 28 shows a front perspective view of the security tool holder 910; FIG. 29 is a front view of the same security tool holder 910. The security tool holder 910 in FIGS. 28 and 29 is used in the same way as the security tool holder 110 in FIGS. 16-25 according to the second disclosed embodiments of the invention, except the open areas 118*a* and 118*b* located on the edges of the tool mount portion 120 are instead implemented as open areas 918*a* and 918*b* within the interior of the top surface of the tool mount portion 920.

In the exemplary embodiment shown in FIGS. 27-29, the thickness of the outer regions of lateral edges 922*a* and 922*b* may be less than the thickness of the lateral edges 122*a* and 122*b* in the previous exemplary embodiments, such as shown in FIGS. 2A and 2B, where the top surface of the tool mount potion 920 does not extend the full length of the lateral edges 922*a* and 922*b*. As a result, the thinner lateral edges 922*a* and 922*b* in this example may facilitate insertion of the tool mount portion 920 into the guide channels 622*a* and 622*b* of the battery receiver slot 600 when a battery powered tool 700 is mounted on the tool mount portion 920.

Those skilled in the art will appreciate that various shapes, sizes, and configurations are possible for the illustrative security tool holders 110 and 910 described with reference to the first, second, and third sets of disclosed embodiments. For example, the height of the front surface 913*a* or 113*a* may be adjusted to correspond to a particular type of battery powered tool, to elevate the displayed battery powered tool to a desired height, or to accommodate a desired size or shape of a price channel 310. In addition, the width of the front surface 913*a* or 113*a* and/or the placement of the alignment holes 912 or 112 may be adjusted to accommodate different sizes and shapes of price channels 310 that may be attached to the front surface 913*a* or 113*a* of the security tool holder 110 or 910.

Figure 30:
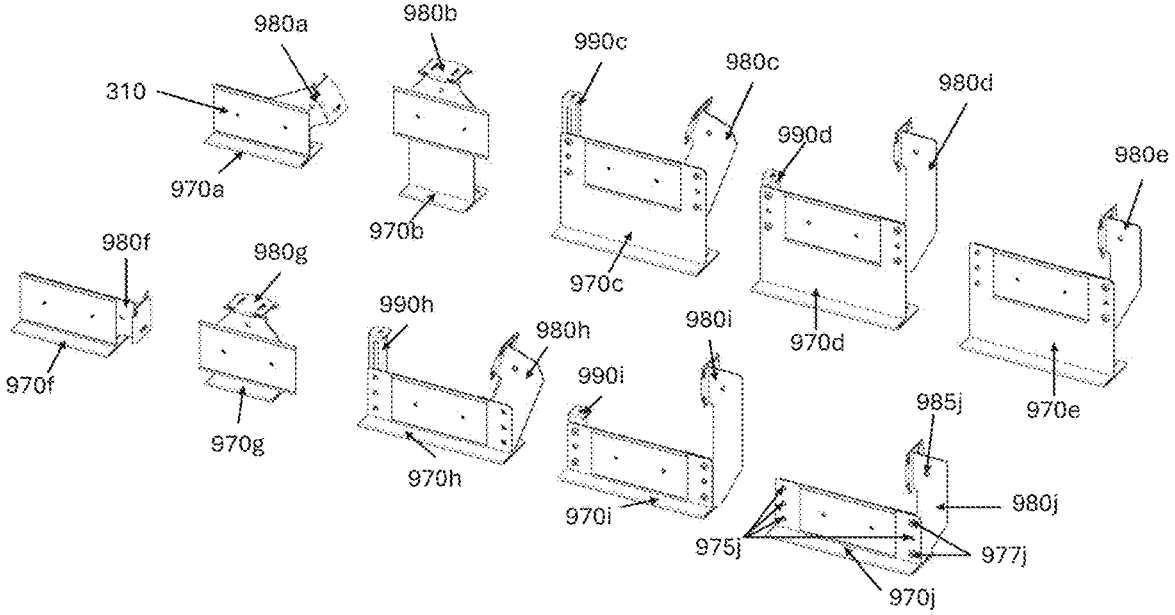
FIG. 30 are front perspective views of alternative embodiments of security tool holders having different configurations for their base portions, which may be formed from one or more individual components, in accordance with various exemplary embodiments of the invention.
Figure 31:
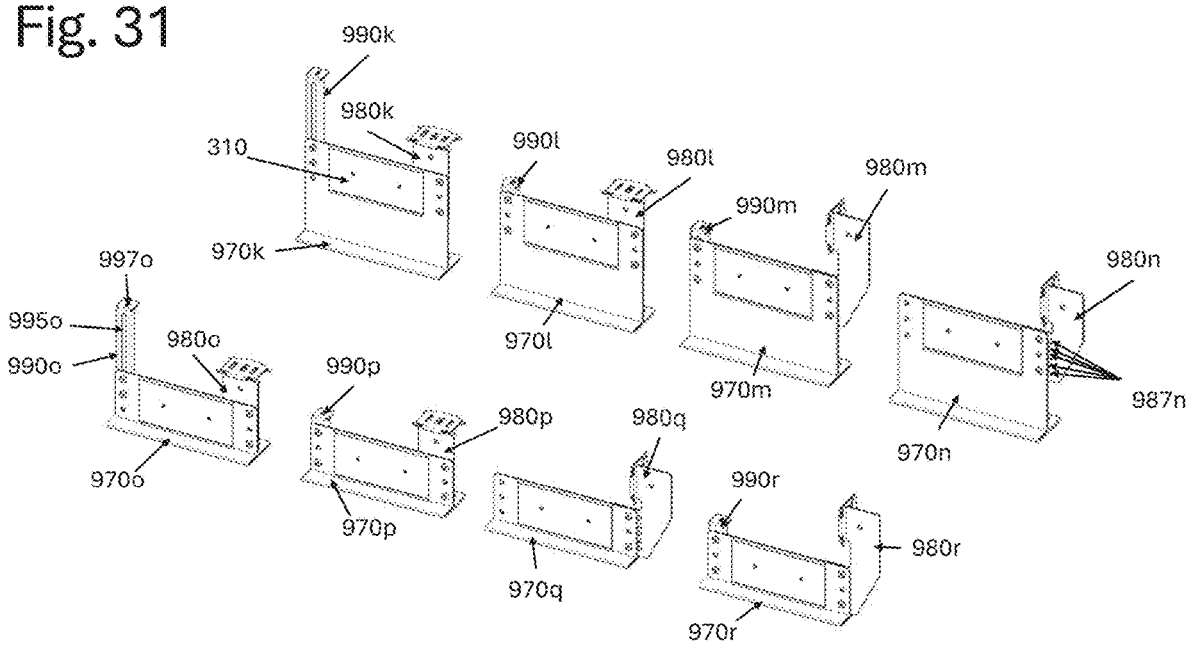
FIG. 31 are front perspective views of additional alternative embodiments of security tool holders having different possible configurations for their base portions, which may be formed from one or more individual components, in accordance with various additional exemplary embodiments of the invention.

FIGS. 30 and 31 provide yet additional exemplary configurations of security tool holders consistent with the disclosed embodiments herein. The exemplary security tool holders in FIGS. 30 and 31 include a base portion 970*a-r*, a tool mount portion 980*a-r*, and, in some embodiments, also a security screw mount portion 990*a-r*. Each example security tool holder in FIGS. 30 and 31 further illustrates a price channel 310 that may be attached to a front surface of the base portion 970*a-r*.

The exemplary configurations in FIGS. 30 and 31 may comprise security tool holders formed from a single piece of material or, alternatively, may comprise multiple interconnected components. For example, the base portion 970*a-r*, tool mount portion 980*a-r*, and/or security screw mount portion 990*a-r* may be formed as a single, integral component, such as the security tool holders comprising base portions 970*b* and 970*g* in FIG. 30, which may be embodiments of the security tool holder 910. In other examples, the tool mount portion 980*a-r* may be formed as a separate component that is attached to a base portion 970*a-r*, such as using screws, bolts, welds, or other fastening means. For example, in the security tool holder comprising the base portion 970*j* (in FIG. 30), the base portion 970*j* may comprise one or more holes 975*j* that may be used to connect the base portion 970*j* to the tool mount portion 980*j* using one or more security screws 977*j* or other fasteners. In this exemplary embodiment, the tool mount portion 980*j* can be attached to either side of the base portion 970*j* by simply connecting it to a different set of holes 975*j* on the base portion 970*j*. In other embodiments, such as the security tool holder including a tool mount portion 980*n* (in FIG. 31), the tool mount portion 980*n* may comprise multiple holes 987*n* that can be used to selectively position the tool mount portion 980*n* at a desired height, angle, and/or position on the base portion 970*n*.

In the exemplary embodiments of FIGS. 30 and 31, the tool mount portion 980*a-r* may be attached at a desired angle, such as at a horizontal or vertical angle relative to a bottom surface of its corresponding base portion 970*a-r*, such as shown in the security tool holders comprising tool mount portions 980*b*, 980*d*, 980*e*, 980*f*, 980*g*, 980*i*, 980*j*, or 980*k-r*, or alternatively may be attached at an angle in-between horizontal and vertical, such as shown in the security tool holders with tool mount portions 980*a*, 980*c*, or 980*h*. In other embodiments (not shown), the tool mount portion 980*a-r* may be adjustably positioned at a desired angle (horizontal, vertical, or in-between) selected from among multiple different supported angles on the base portion 980*a-r* to which it is attached.

In some embodiments, the tool mount portion 980*a-r* may comprise a straight or angled extension portion corresponding to the angle and/or position of a battery powered tool may be mounted thereon for display to a customer. In some embodiments, the tool mount portion 980*a-r* further may comprise a lock-bracket hole, such as the exemplary hole 985*j*, located in close proximity to the top surface of the tool mount portion 980*a-r* for attaching a lock bracket to the tool mount portion 980*a-r*. More generally, in FIGS. 30 and 31, each of the tool mount portions 980*a-r* is shown with a hole (such as hole 985*j*) that may be used to attach a lock bracket.

Some of the exemplary security tool holders in FIGS. 30 and 31 also support a security screw for use in accordance with the first set of exemplary embodiments herein. For example, the security tool holders comprising base portions 970*c*, 970*h*, 970*i*, 970*k*, 9701, 970*o*, 970*p*, and 970*r* each comprises a respective security screw mount portion 990*c*, 990*h*, 990*i*, 990*k*, 9901, 990*o*, 990*p*, and 990*r*. Each security screw mount portion includes a hole on its top surface, such as a threaded hole, in which a security screw may be inserted. For example, using the security screw mount portion 990*o* in FIG. 31 as an example, the top surface of the security screw mount includes a hole 997*o* configured to receive a security screw (not shown).

The security screw mount portions 990*c*, 990*h*, 990*i*, 990*k*, 9901, 990*o*, 990*p*, and 990*r* may be attached at a fixed height and/or angle or, alternatively, may enable a user to select a desired height and/or angle from among different possible positions. For example, using security screw mount portion 990*o* as an example, the security screw mount portion 990*o* may comprise one or more openings or a channel 995*o* in which a security screw (or other set screw) may be inserted to lock the height and/or angular position of the security screw mount portion 990*o*.

The foregoing description has been directed to specific embodiments. It will be apparent, however, that other variations and modifications may be made to the described embodiments, with the attainment of some or all of their advantages. For example, those skilled in the art will understand that various types of security screws, bolts, or other fasteners may be used in the disclosed embodiments consistent with the present invention. Further, one or more washers or other spacers also may be employed with the screws, bolts, and other fasteners herein in accordance with the disclosed embodiments. While the described holes and openings may be described as circular or elongated, other shapes are possible. Further, the various disclosed holes may be untapped or threaded in the exemplary embodiments described herein.

In addition, the disclosed embodiments describe exemplary shapes, locations, and dimensions solely for purposes of explanation and examples. Other dimensions and shapes alternatively may be used without loss of generality as to the inventive concepts herein. Further still, some disclosed embodiments may be described in terms of configurations having "substantially" flat, straight, parallel, perpendicular, vertical, etc., features. Those skilled in the art will understand that such descriptions include any acceptable tolerances relative to the described configurations that still function consistent with their descriptions herein. The term "substantially" thus allows for insignificant variations from an absolute or perfect state, dimension, direction, measurement, result, or the like.

While the disclosed embodiments have been described with reference to certain "exemplary" implementations and flowcharts, those skilled in the art will appreciate that other variations and configurations are possible within the scope of the invention. Any embodiment or embodiment described herein as "exemplary" is not necessarily to be construed as preferred or advantageous over other embodiments. For instance, one or more of the disclosed steps in the exemplary flow charts of FIGS. 15 and 25 may be combined or otherwise integrated with other disclosed steps. In some embodiments, the disclosed steps of the flow diagrams may be performed in different orders than shown in the exemplary methods. For instance, the components disclosed in the exemplary embodiments and the steps in the exemplary flow charts may be variously combined, separated, removed, reordered, and replaced in a manner other than as expressly described and depicted in this disclosure.

Accordingly, this description is to be taken only by way of example and not to otherwise limit the scope of the invention defined by the appended claims. Therefore, it is the object of the appended claims to cover all such variations and modifications as come within the true spirit and scope of the invention described herein.

The invention claimed is:

1. A security tool holder for securely displaying a battery powered tool in a merchandise display system, the security tool holder comprising:

a base portion configured to attach the security tool holder to the merchandise display system; and a tool mount portion configured to attach to a battery receiver slot in the battery powered tool, wherein the tool mount portion comprises first and second lateral edges configured to fit within first and second guide channels in the battery receiver slot of the battery powered tool, wherein the base portion of the security tool holder further comprises a bottom surface including one or more holes configured to attach the security tool holder to the merchandise display system, and wherein the bottom surface of the base portion is configured to attach to a shelf of the merchandise display system using screws inserted through the one or more holes in the bottom surface and a corresponding set of one or more holes in the shelf of the merchandise display system.

2. The security tool holder of claim 1, wherein the security tool holder further comprises a lock bracket including a tab configured to fit within a groove in the battery receiver slot when the battery powered tool is mounted on the tool mount portion.

3. The security tool holder of claim 2, wherein the tab is configured to extend through an open area on the tool mount portion and into the groove in the battery receiver slot when the battery powered tool is mounted on the tool mount portion.

4. The security tool holder of claim 3, wherein the open area on the tool mount portion is an opening within an interior of the tool mount portion's top surface.

5. The security tool holder of claim 3, wherein the open area on the tool mount portion is formed along an edge of the tool mount portion.

6. The security tool holder of claim 2, wherein the base portion has a front surface and a back surface and a hole formed therethrough, and wherein the lock bracket is attached to the back surface of the base portion using a security screw inserted through the hole.

7. A security tool holder for securely displaying a battery powered tool in a merchandise display system, the security tool holder comprising:

a base portion configured to attach the security tool holder to the merchandise display system; and a tool mount portion configured to attach to a battery receiver slot in the battery powered tool, wherein the tool mount portion comprises first and second lateral edges configured to fit within first and second guide channels in the battery receiver slot of the battery powered tool, wherein the security tool holder further comprises a lock bracket including first and second tabs, wherein the first tab on the lock bracket is configured to fit within a groove in the battery receiver slot when the battery powered tool is mounted on the tool mount portion in a first orientation, and wherein the second tab is configured to fit within the groove in the battery receiver slot when the battery powered tool is mounted on the tool mount portion in a second orientation.

8. The security tool holder of claim 7, wherein the first tab is configured to extend through a first open area on the tool mount portion and into the groove in the battery receiver slot when the battery powered tool is mounted on the tool mount portion in the first orientation, and wherein the second tab is configured to extend through a second open area on the tool mount portion and into the groove in the battery receiver slot when the battery powered tool is mounted on the tool mount portion in the second orientation.

9. The security tool holder of claim 8, wherein the first open area on the tool mount portion is a first opening within an interior of the tool mount portion's top surface, and wherein the second open area on the tool mount portion is a second opening also within the interior of the tool mount portion's top surface.

10. The security tool holder of claim 8, wherein the first and second open areas on the tool mount portion are formed along opposite edges of the tool mount portion.

11. A security tool holder for securely displaying a battery powered tool in a merchandise display system, the security tool holder comprising:

a base portion configured to attach the security tool holder to the merchandise display system; and a tool mount portion configured to attach to a battery receiver slot in the battery powered tool, wherein the tool mount portion comprises first and second lateral edges configured to fit within first and second guide channels in the battery receiver slot of the battery powered tool, wherein the security tool holder further comprises a security screw configured to block removal of the battery powered tool from the tool mount portion when the battery powered tool has been mounted on the tool mount portion.

12. The security tool holder of claim 11, wherein the security screw is attached to a surface of the security tool holder within a cylindrical spacer, and wherein a height of the cylindrical spacer ensures that the security screw extends sufficiently above the surface to block removal of the battery powered tool from the tool mount portion.

13. The security tool holder of claim 1, wherein the base portion and the tool mount portion of the security tool holder are formed from a single sheet of material.

14. The security tool holder of claim 1, wherein the battery receiver slot is configured to receive a 20 Volt battery.

15. The security tool holder of claim 1, wherein the battery powered tool is a drill.

16. The security tool holder of claim 11, wherein the base portion of the security tool holder further comprises a bottom surface including one or more holes configured to attach the security tool holder to the merchandise display system.

17. The security tool holder of claim 16, wherein the bottom surface of the base portion is configured to attach to a shelf of the merchandise display system using screws inserted through the one or more holes in the bottom surface and a corresponding set of one or more holes in the shelf of the merchandise display system.

18. The security tool holder of claim 1, wherein the tool mount portion has a substantially flat top surface that is positioned substantially horizontal relative to at least one of a bottom surface of the security tool holder, the ground, or a surface on the merchandise display system.

19. The security tool holder of claim 1, wherein the tool mount portion is positioned at a desired angle relative to the base portion.

20. The security tool holder of claim 1, wherein the base portion and the tool mount portion in the security tool holder are separate interconnected components.

* * * * *